US006962554B2

(12) United States Patent
Keiser

(10) Patent No.: US 6,962,554 B2
(45) Date of Patent: Nov. 8, 2005

(54) EXERCISING APPARATUS

(75) Inventor: Dennis L. Keiser, Sanger, CA (US)

(73) Assignee: Keiser Corporation, Fresno, CA (US)

( * ) Notice: Subject to any disclaimer, the term of this patent is extended or adjusted under 35 U.S.C. 154(b) by 0 days.

(21) Appl. No.: 09/945,026

(22) Filed: Aug. 31, 2001

(65) Prior Publication Data

US 2002/0025890 A1 Feb. 28, 2002

Related U.S. Application Data

(63) Continuation of application No. 09/069,057, filed on Apr. 28, 1998, now abandoned, which is a continuation of application No. 08/405,494, filed on Mar. 15, 1995, now abandoned.

(51) Int. Cl.[7] ..... A63B 21/008

(52) U.S. Cl. ..... 482/112; 482/137; 482/138; 482/142; 482/908

(58) Field of Search ..... 482/111–113, 100–103, 482/135–138, 908

(56) References Cited

U.S. PATENT DOCUMENTS

| | | | | |
|---|---|---|---|---|
| 1,015,071 A | | 1/1912 | Reach | |
| 2,932,509 A | | 4/1960 | Zinkin | |
| 3,074,716 A | | 1/1963 | Mitchel et al. | |
| 3,387,843 A | | 6/1968 | Chandler | |
| 3,451,271 A | | 6/1969 | Knoblauch | |
| 3,692,296 A | | 9/1972 | Higginbotham | |
| 3,784,194 A | | 1/1974 | Perrine | |
| 3,822,599 A | | 7/1974 | Brentham | |
| 4,050,310 A | | 9/1977 | Keiser | |
| 4,227,689 A | | 10/1980 | Keiser | |
| 4,247,098 A | * | 1/1981 | Brentham | 482/112 |
| 4,256,302 A | | 3/1981 | Keiser et al. | |
| 4,257,593 A | | 3/1981 | Keiser | |
| 4,326,707 A | | 4/1982 | Strecker | |
| 4,500,089 A | | 2/1985 | Jones | |
| 4,549,733 A | * | 10/1985 | Salyer | 482/103 |
| 4,609,190 A | * | 9/1986 | Brentham | 482/8 |
| 4,700,946 A | * | 10/1987 | Breunig | 482/57 |
| 4,720,099 A | * | 1/1988 | Carlson | 482/133 |
| 4,722,525 A | | 2/1988 | Brentham | |
| 4,730,829 A | | 3/1988 | Carlson | |
| 4,911,436 A | * | 3/1990 | Lighter | 482/113 |
| 4,915,379 A | | 4/1990 | Sapp | |
| 4,976,426 A | * | 12/1990 | Szabo et al. | 482/6 |
| 5,018,725 A | * | 5/1991 | Cook | 482/103 |
| 5,044,632 A | * | 9/1991 | Jones | 482/138 |
| 5,060,939 A | | 10/1991 | Oswald et al. | |
| 5,102,122 A | * | 4/1992 | Piane et al. | 482/133 |
| 5,145,479 A | * | 9/1992 | Olschansky et al. | 482/62 |

(Continued)

FOREIGN PATENT DOCUMENTS

FR 2581550 A1 * 11/1986 ..... A63B 23/04

(Continued)

*Primary Examiner*—Jerome W. Donnelly
*Assistant Examiner*—Victor K. Hwang
(74) *Attorney, Agent, or Firm*—Knobbe Martens Olson & Bear LLP

(57) ABSTRACT

An exercise apparatus having a frame with a predetermined reference position, an engagement assembly for use by an operator during exercise, a system for resisting movement of the engagement assembly by the operator during exercise and a mechanism mounting the engagement assembly for selective movement along a path of travel relative to the reference position for purposes of controlling the exercise of the operator positioned relative to the reference position.

45 Claims, 9 Drawing Sheets

U.S. PATENT DOCUMENTS

| | | | |
|---|---|---|---|
| 5,310,394 | A | 5/1994 | Kallios |
| 5,336,145 | A | 8/1994 | Keiser |
| 5,403,257 | A | 4/1995 | Lehtonen |
| 5,526,692 | A | 6/1996 | Keiser |
| 5,776,040 | A | 7/1998 | Webb et al. |
| 5,890,996 | A | 4/1999 | Frame et al. |
| 6,142,919 | A | 11/2000 | Jorgensen |
| 6,447,430 | B1 | 9/2002 | Webb et al. |

FOREIGN PATENT DOCUMENTS

| | | |
|---|---|---|
| FR | 2 645 032 | 10/1990 |
| GB | 2240727 | 8/1991 |

* cited by examiner

EXERCISING APPARATUS

RELATED CASES

This application is a continuation of application Ser. No. 09/069,057, filed Apr. 28, 1998, now abandoned, which is a continuation of application Ser. No. 08/405,494, filed Mar. 15, 1995, now abandoned.

BACKGROUND OF THE INVENTION

1. Field of the Invention

The present invention relates to an exercising apparatus and, more particularly, to such an exercising apparatus which has particular utility in affording capabilities not heretofore possible using prior art exercising equipment.

2. Description of the Prior Art

The development of exercising equipment is, from an historical perspective, a relatively recent phenomenon. While free weights have been known for a somewhat longer period of time, mechanical exercising equipment has existed for only a few decades. For example, exercising equipment employing one or more stacks of weight plates as the resistance force have been known for several decades. Such a device is depicted in the Zinkin U.S. Pat. No. 2,932,509 which was issued in 1960. Devices of this type were a substantial advance in the art in a variety of respects. By employing weight stacks, the desired amount of weight could readily be selected and applied as the resistance force during the performance of a particular exercise. Since the weight plates were captured within the device and the path of travel thereof controlled by the device during exercising, there was significantly less risk of injury to the operator. The operator was free to concentrate on the form and repetition involved in the particular exercise without the distraction of retaining the weights within a prescribed path as required with free weights. These benefits and others experienced in the use of such prior art exercising equipment were significant and resulted in the development of an entirely new industry.

Other advances in the art included the development of exercising equipment having multiple stations in a single unit. The aforementioned patent depicts such a device. The operator was permitted to perform a multiplicity of different types of exercises in a single unit by virtue of the multiple stations. Such prior art devices constituted an improvement over the prior art in that a plurality of exercises could be performed without having a corresponding plurality of discrete exercising devices. This was not only substantially less expensive, but required significantly less space. Other improvements in equipment of this type included devices which employed a single common weight stack for use by the operator at all of the stations thereof. This not only reduced the expense of such equipment, but allowed the devices to be produced in substantially smaller sizes.

Thereafter, hydraulic and pneumatic exercising machines were developed. Such machines employed a fluid or a gas as the resistance force rather than the comparatively cumbersome weight stacks of prior art devices. For example, the Keiser U.S. Pat. No. 4,050,310 issued in 1977 is directed to an hydraulic exercising machine. The Keiser U.S. Pat. No. 4,257,593 issued in 1981 is directed to a pneumatic exercising apparatus upon which an entirely new segment of the industry was developed. Such devices have numerous operative advantages over the prior art, particularly for certain uses. They are less cumbersome and generally expensive than free weight machines. They possess a virtually infinite degree of adjustability, unlike free weight machines. They avoid the development of inertia characteristic of the weight stack in free weight machines. There are a plurality of more arcane advantages in such pneumatic exercising machines.

Thus, the state of the art relative to exercising equipment includes a plurality of types of exercising devices having a melange of relative attributes and detriments. However, all conventional exercising devices suffer from several universal operative disadvantages. There has not heretofore, as a practical matter, been an exercising device capable of permitting an operator simultaneously to exercise both upper body and lower body musculature. Conventional exercising equipment of any truly effective type requires that the operator exercise only selected upper body muscles, or selected lower body muscles at any one time. While it has been recognized that it would be desirable to be able to exercise the upper body and lower body at the same time, no satisfactory device for achieving this objective has heretofore been developed.

In addition, all prior art exercising equipment requires that the operator either adjust to the machine, or reconfigure the machine, in order to perform a different exercise than the one previously performed. Such repositioning and/or reconfiguring necessitates a relatively substantial delay in the exercising program. This detracts from what would otherwise be an optimum program of exercise. This imperative has prevented the development of exercising programs of any particular level of sophistication. It has not heretofore been possible, as a practical matter, to vary the resistance force during continuous exercising; or to vary the attitude of exercising during continuous exercising; or to vary both the resistance force and the attitude of exercising; or to be able to provide such variation for simultaneous exercising of both the upper and lower body; or to permit exercising in different environments such as those having substantially reduced gravity as compared with that of the planet earth while maintaining substantially identical parameters for such exercising; or to achieve all, or any combination, of the foregoing objectives with a precision in both control and adjustability permitting a substantial advance in the benefits to be achieved in accordance with a regimen for exercise which may be either of a basic or sophisticated design.

Therefore, it has long been known that it would be desirable to have an exercising apparatus which permits upper body and lower body musculature to be exercised simultaneously; which is readily adjustable to precise selected configurations for exercising under the control of the operator; which affords the capability of exercising with precisely the same operative effects in substantially dissimilar operative environments; which affords the capability of exercising in accordance with a program of exercise permitting both the resistance force and the attitude of such exercising to be varied during substantially continuous exercising; which is compact and suitable for use in operative environments such as extraterrestrial environments in which the magnitude of gravity is substantially reduced relative to that of the planet earth; and which is otherwise entirely successful in achieving its operational objectives.

SUMMARY OF THE INVENTION

Therefore it is an object of the present invention to provide an improved exercising apparatus.

Another object is to provide such an exercising apparatus which possesses a capability for use in the performance of exercises, and combinations of exercises, not heretofore achievable in the art.

Another object is to provide such an exercising apparatus which is entirely adaptable to a virtually infinite number of usages from a single configuration.

Another object is to provide such an exercising apparatus which simultaneously permits both upper body and lower body exercise.

Another object is to provide such an exercising apparatus which is adjustable for the performance of a virtually infinite number of exercising motions, all at the selection of the operator.

Another object is to provide such an exercising apparatus which affords a precision of adjustment not heretofore achieved in the art so that the optimum results can be achieved.

Another object is to provide such an exercising apparatus which permits the operator to adjust both the resistance force and the attitude of exercising during substantially continuous exercising so as to permit the performance of a range of exercises within a single continuous exercising program.

Another object is to provide such an exercising apparatus which affords the operator a panoply of data revealing the operator's performance during such exercising and similarly provides the operator with an array of selections for adjustment of the exercising apparatus more precisely to achieve the desired operative results.

Another object is to provide such an exercising apparatus which is particularly well suited to usage in extraterrestrial environments, such as space vehicles, space stations, and other operative environments in which the magnitude of gravity is different from that of the planet earth.

Another object is to provide such an exercising apparatus which is capable of usage in a multiplicity of operative environments while affording precisely the same performance characteristics.

Another object is to provide such an exercising apparatus which is disposable in a collapsed attitude particularly well suited to storage in confined areas, such as aboard space vehicles and in other environments wherein the size of the apparatus is of significance because of spacial limitations.

Another object is to provide such an exercising apparatus which is of very light weight and thereby particularly well suited to transport aboard space vehicles wherein there may be a restricted launch weight.

Another object is to provide such an exercising apparatus which is readily adaptable for usage in a wide range of commercial environments, including usage in the home, in private and public gymnasiums, at academic and professional athletic institutions and in virtually any environment within which physical exercise is desired or required.

Another object is to provide such an exercising apparatus which is particularly well suited to usage by astronauts during space flights for the purpose of avoiding muscle deterioration, decalcification of bone structure and other debilitating results from operation in an environment of substantially reduced gravity.

Further objects and advantages are to provide improved elements and arrangements thereof in an apparatus for the purpose described which is dependable, economical, durable and fully effective in accomplishing its intended purpose.

These and other objects and advantages are achieved, in the preferred embodiment of the exercising apparatus of the present invention, in an exercise apparatus having a frame with a predetermined reference position, an engagement assembly for use by an operator during exercise, a system for resisting movement of the engagement assembly by the operator during exercise and a mechanism mounting the engagement assembly for selective movement along a path of travel relative to the reference movement along a path of travel relative to the reference position for purposes of controlling the exercise of the operator positioned relative to the reference position.

DESCRIPTION OF THE PREFERRED EMBODIMENT

Figure 1:
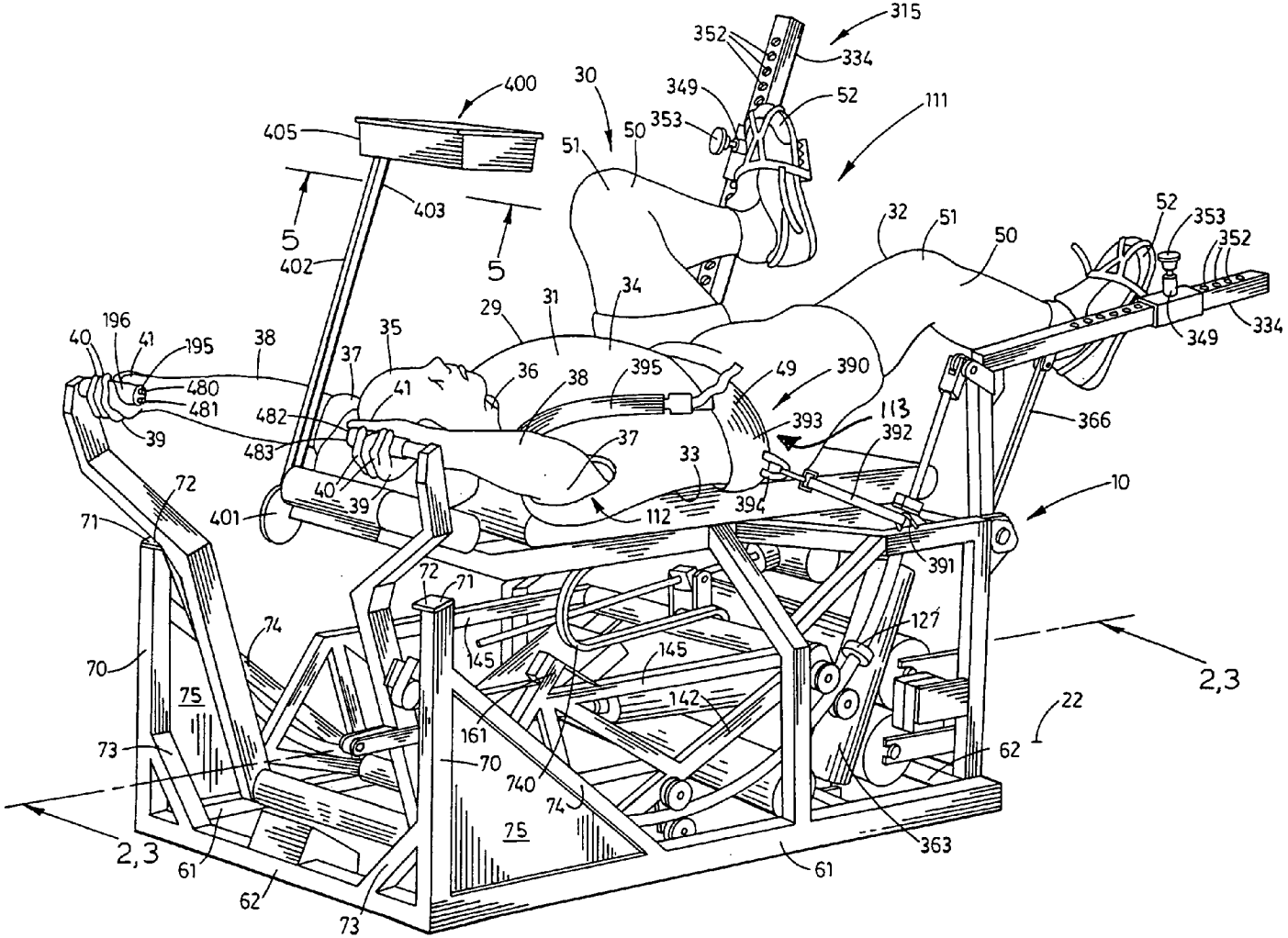
FIG. 1 is a perspective view of the exercising apparatus of the present invention shown in a typical operative environment with an operator in a typical operative attitude in the operator's station thereof and exemplifying usage of the exercising apparatus in an environment of substantially reduced gravity, such as during travel in an extraterrestrial environment such as aboard a space vehicle.

Referring more particularly to the drawings, the exercising apparatus of the present invention is generally indicated by the numeral 10 in FIG. 1.

The exercising apparatus is not limited in any respect to usage in a particular operative environment. Nonetheless, the exercising apparatus of the present invention has unique operative advantages when employed in an environment of substantially reduced gravity, such as aboard a space vehicle and, particularly, when so employed for sustained periods of time, such as during prolonged space flights and aboard space stations. It has been discovered, through extraterrestrial space exploration to date, that subjection of the human body to such an environment of reduced gravity causes muscular and bone deterioration and, perhaps, other long term effects. It is believed that this degenerative process begins immediately and continues throughout the period of exposure to the low gravity environment. It is also believed that it may not be possible to restore this muscle and bone loss upon return to the earth. Accordingly, the development of some means for preempting this deteriorative process is of paramount importance if prolonged space exploration is to be a practical reality. It is now postulated that frequent exercise by astronauts during such space flight may prevent, or retard, these effects of exposure to a reduced gravity environment. Accordingly, the development of a suitable exercising apparatus for such space flight is of considerable importance.

Figure 4:
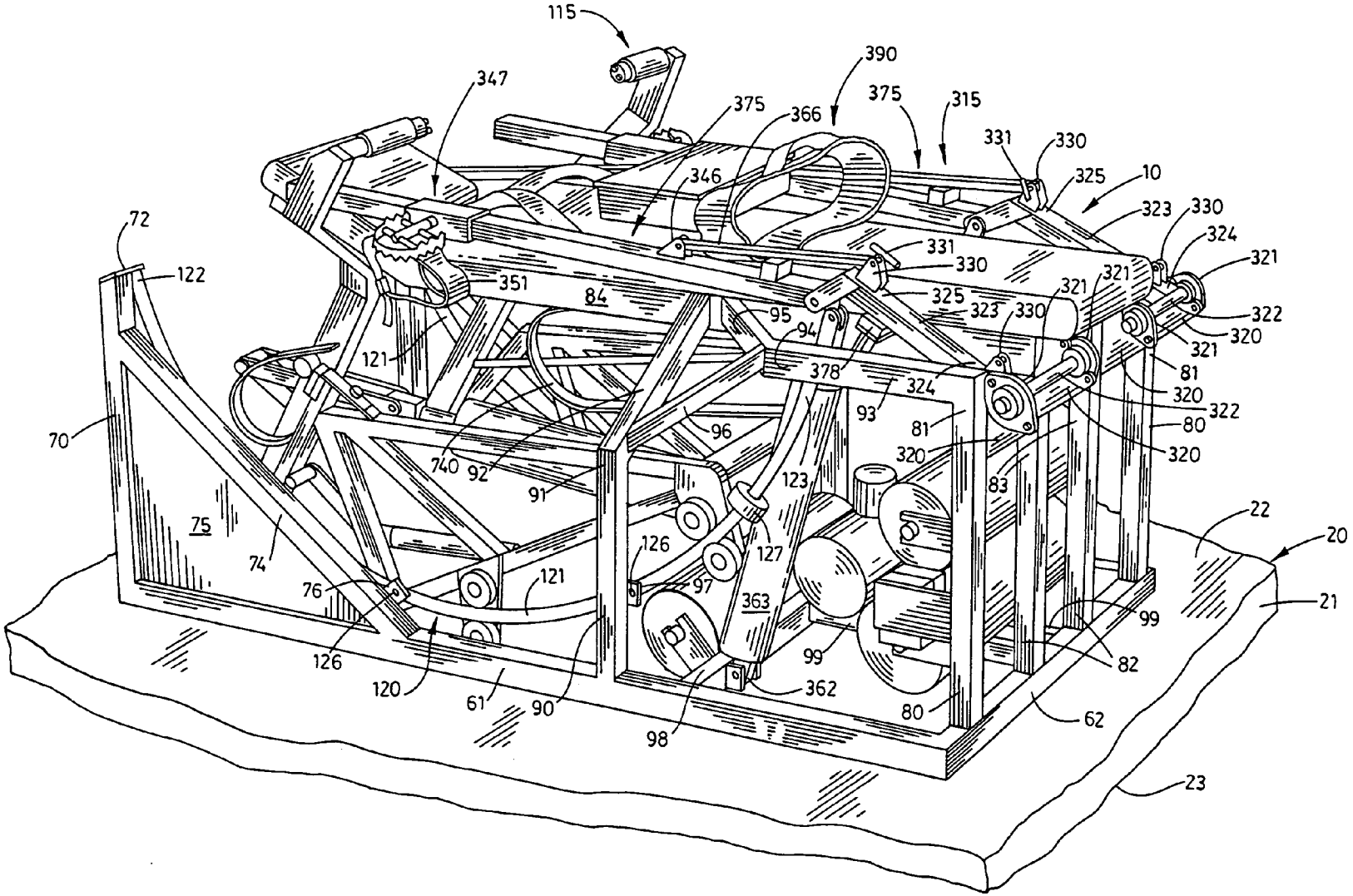
FIG. 4 is a somewhat enlarged, fragmentary perspective view of the exercising apparatus deployed in a collapsed, stored configuration.

Only for purposes of illustrative convenience, the exercising apparatus 10 of the present invention will be described, in part, as employed in such an environment. In this respect, a mounting structure 20 is shown in FIG. 4. Again, for purposes of illustrative convenience, the mounting structure may be visualized as a wall or bulkhead of a space vehicle or space station. Thus, more specifically, the exercising apparatus is mounted on a bulkhead 21 of such a space vehicle having an interior surface 22 and an exterior surface 23.

An operator is generally indicated by the numeral 29 in FIG. 1. The operator, again for illustrative convenience only, may be considered to be an astronaut exercising in an environment of substantially reduced gravity such as aboard a space vehicle in extraterrestrial travel. It will be understood that the space vehicle is insulated and pressurized with an artificial environment so that the occupants need not use pressure or space suits. However, the interior of the space vehicle is subjected to little or no gravitational attraction. Thus, all of the contents of the space vehicle including the astronauts are free to float within the space vehicle unless otherwise secured in place.

The operator 29 is shown in a supine attitude 30 in FIG. 1 and has, generally, an upper body 31 and a lower body 32. The operator may also generally be viewed as having a-back 33 and a front 34. Similarly, the operator has a head 35, neck 36 and shoulders 37. The operator's arms are indicated at 38 and the hands at 39. The operator's fingers are indicated by the numeral 40 and thumbs by the numerals 41. Still further, the operator's waist is indicated at 49, legs at 50, knees at 51 and feet at 52.

Turning then to the exercising apparatus 10 itself, the apparatus has a main frame generally indicated by the numeral 60. The main frame can be constructed of any suitable material, such as tubular steel. In this illustrative operative environment, the exercising apparatus is to be employed in a reduced gravity environment, but must be launched into space aboard a space vehicle. Accordingly, the conservation of weight and space may be important. The main frame has a pair of substantially parallel, longitudinal frame members 61 interconnected by a pair of transverse frame members 62 extending therebetween in spaced, parallel relation. Thus, the longitudinal and transverse frame members form a rectangular configuration. The main frame is mounted on, or rested upon, a surface of support by mounting assemblies 63 which are mounted on the interior surface 22 of the bulkhead 21. It will be understood that in other operative environments under normal earth gravity conditions, the main frame can simply be rested on a surface of support in which case the mounting assemblies may be replaced by adjustable rests for this purpose.

The main frame 60 has two upright forward frame members 70 individually extended upwardly from the junctures of the respective longitudinal and transverse members 61 and 62, respectively, and in right angular relation thereto. The forward frame members terminate in slanted upper surfaces 71 together defining a plane sloping downwardly from right to left, as viewed in FIGS. 2A and 2B. Mounting plates 72 are mounted, as by welding, on the slanted upper surfaces and extend inwardly short distances toward each other. The forward frame members are individually supported by transverse brace members 73 interconnecting the transverse frame member and its respective forward frame member. Similarly, longitudinal brace members 74 individually extend between each longitudinal frame member and its respective forward frame member. The area prescribed by each longitudinal frame member, forward frame member and longitudinal brace member is covered by a plate 75. A mounting plate 76 is mounted on each longitudinal brace member in a predetermined position, as shown in FIG. 4.

A pair of upright outer rearward frame members 80 are individually mounted on the rearward transverse frame member 62 in spaced, parallel relation extending upwardly to upper end portions 81. As shown in FIG. 4, the outer rearward frame members are individually inwardly spaced from the junctures of their respective transverse frame member and the adjacent longitudinal frame member 61. Similarly, a pair of upright inner rearward frame members 82 are mounted on the rearward transverse frame member extending upwardly therefrom in spaced, parallel relation between the outer rearward frame members and to upper end portions 83. Support beams 84 are individually mounted on the upper end portions 83 of the inner rearward frame members 82 and extend along courses parallel to each other and to the longitudinal frame members 61 to distal end portions 85 nearer the forward frame members 70.

A pair of lateral frame members 90 are mounted on, and extend upwardly from, each longitudinal frame member 61 to upper end portions 91. Lateral support members 92 are individually mounted on the upper end portions 91 of the lateral frame members 90 and extend to, and are mounted on, the central support beams 84, as shown best in FIG. 4. Side frame members 93 are individually mounted, as by welding, on the upper end portions 81 of the outer rearward frame members 80 and extend to distal end portions 94 along courses disposed in spaced, parallel relation to the central support beams 84. A convergent brace member 95 is mounted on the distal end portion 94 of each side frame member 93 and extends to, and is mounted on, the central support beam 84. Similarly, a divergent brace member 96 is mounted on the distal end portion 94 of each side frame member 93 and extends to, and is mounted on, the adjacent lateral support member 92 so as to form the substantially triangular configuration visible in FIG. 4. A mounting plate 97 is mounted on each lateral frame member 90 in a predetermined position, as shown in FIG. 4. A transverse frame member 98 interconnects the longitudinal frame members 61. A pair of longitudinal frame members 99 interconnects transverse frame member 62 on the right, as viewed in FIG. 4, and the transverse frame member 98.

Figure 2A:
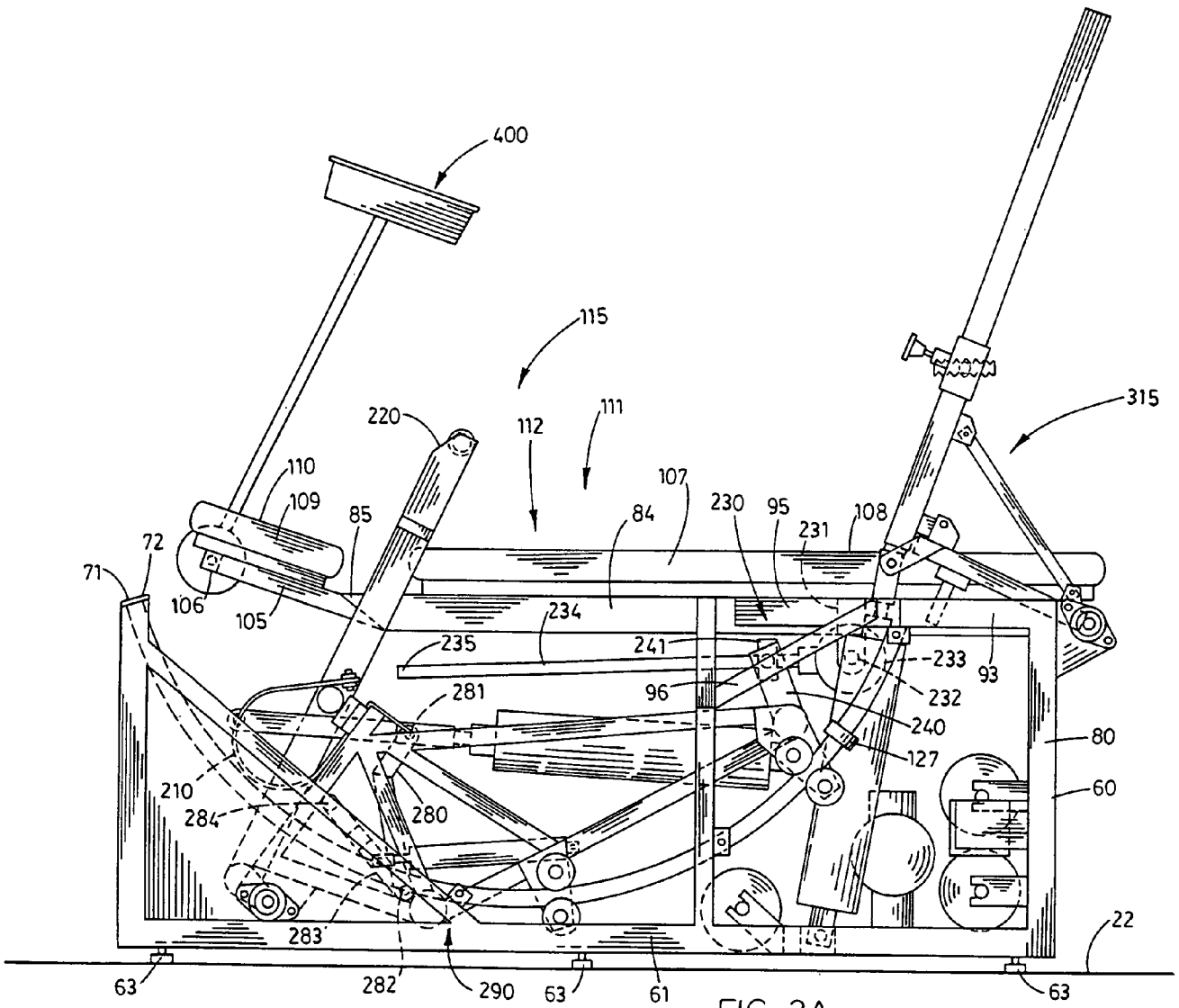
FIG. 2A is a side elevation of the exercising apparatus of FIG. 1 taken from a position indicated by line 2—2 therein.
Figure 2B:
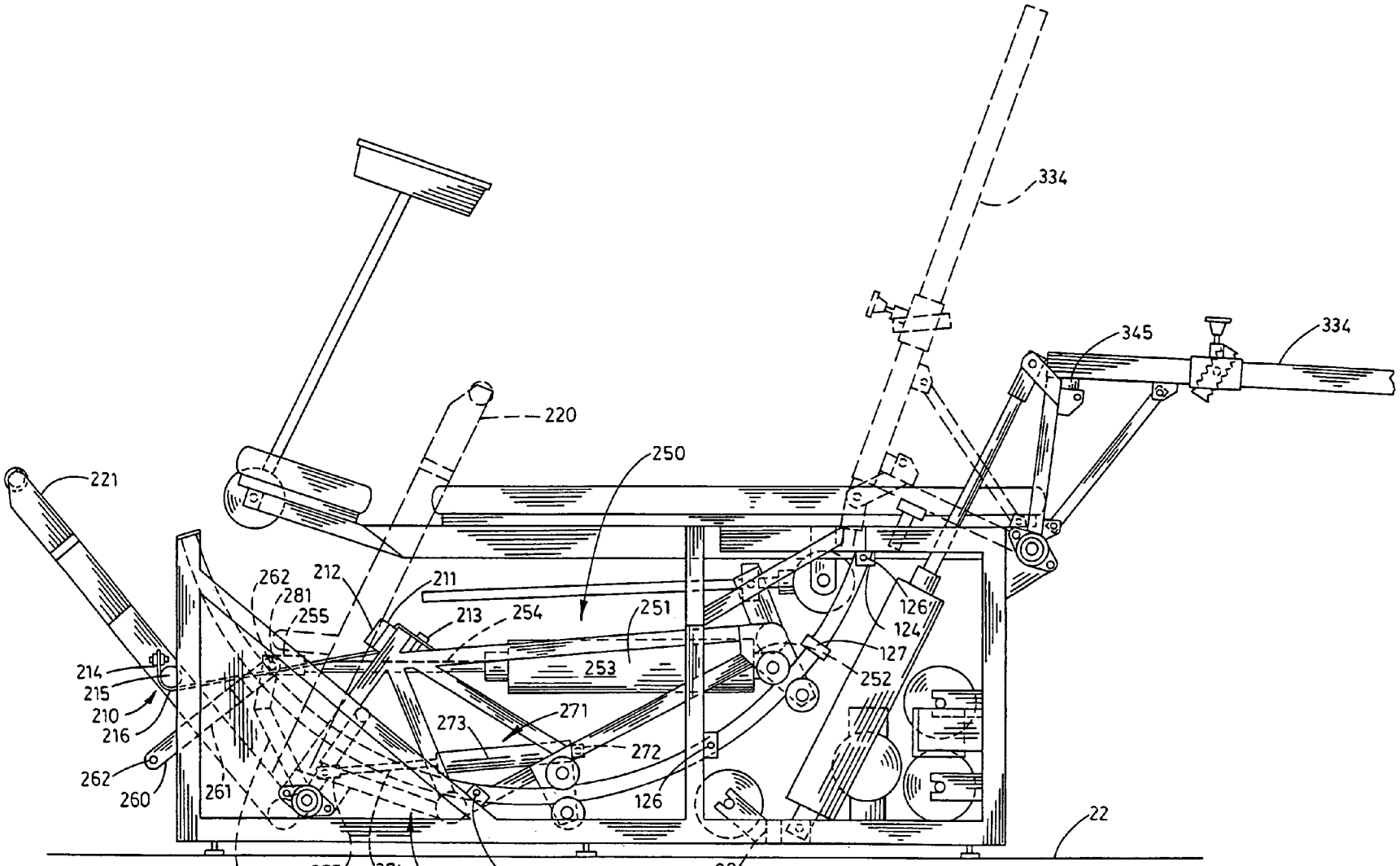
FIG. 2B is a side elevation of the exercising apparatus taken from a position indicated by line 2—2 in FIG. 1 and showing the exercising members thereof in full lines in extended operational positions and in phantom lines in retracted operational positions.

A pair of oblique side members 105 are individually mounted on the distal end portions 85 of the central support beams 84 and extend upwardly at an angle therefrom from right to left, as viewed in FIGS. 2A and 2B. The distal end portions of the oblique side members are interconnected by a transverse member 106 extending therebetween. A body support assembly 107 is mounted on the central support beams 84 and has a contact surface 108. The body support assembly is preferably cushioned so as to provide comfortable support in a normal gravity environment for an operator. Similarly, a head support assembly 109 is mounted on the oblique side members 105 and transverse member 106 and has a contact surface 110. Similarly, the head support assembly is preferably cushioned for comfortable use in a normal gravity environment. The body support assembly and head support assembly thus form an operator's station generally indicated by the numeral 111. For illustrative convenience, and as depicted in FIG. 1, when the operator 29 is in the supine attitude 30, as shown therein, the shoulders 37 of the operator define a first reference position generally indicated by the numeral 112 which may be viewed as extending transversely across the contact surface 108 of the body support assembly along an axis generally extending through the shoulders of the operator. The significance of this reference position will hereinafter be described. Similarly, when the operator 29 is in the supine attitude 30, as shown in FIG. 1, the hips of the operator may be viewed as defining a second reference position 113.

Upper Body Exercise Mechanism

The exercising apparatus 10 has an upper body exercise mechanism generally indicated by the numeral 115. The upper body exercise mechanism has a track assembly generally indicated by the numeral 120. The track assembly includes a pair of arcuate track members 121 each describing a segment of a circle and each having a front end portion 122 and an opposite rear end portion 123. Each of the arcuate track members is preferably cylindrical in cross section and is mounted on the main frame 60, as hereinafter described.

A rear mounting plate 124 is mounted on, and extends downwardly from, each of the side frame members 93. Thus, the mounting plates 76, 97 and 124 on each side of the main frame are preferably disposed in the same vertical plane on the interior sides of their respective frame members. Each arcuate track member is mounted on its respective mounting plates 76, 97 and 124 by mounting pins 126 individually extending inwardly of the main frame from their respective mounting plates and mounting their respective arcuate track member on the end portions thereof in the configuration shown in the drawings. As previously noted, each arcuate track member is a segment of a circle. The arcuate track members 121 are substantially concentric to the reference position 112 which, as noted, may be viewed as an axis extending through the shoulders 37 of an operator 29 disposed in the operator's station 111 in the supine attitude 30 shown in FIG. 1. Thus, in effect, the arcuate track members together define a segment of a cylinder extending transversely of the main frame. Stop rings 127 are individually mounted on the arcuate track members 121 in corresponding, predetermined positions for purposes subsequently to be described.

Figure 3A:
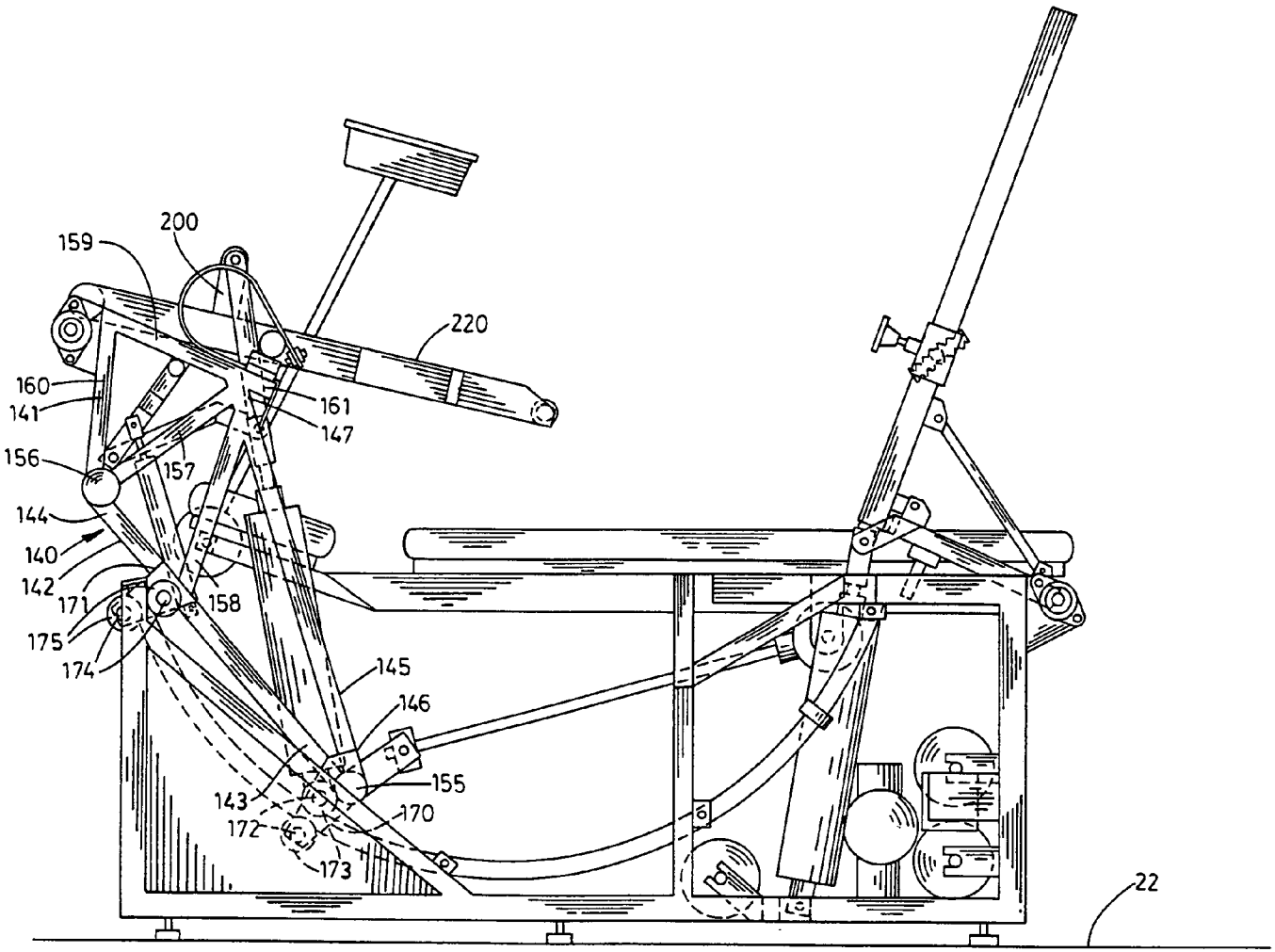
FIG. 3A is a side elevation of the exercising apparatus taken from a position indicated by line 3—3 in FIG. 1 and showing the carriage assembly thereof in an advanced position on the track assembly thereof.

The upper body exercise mechanism 115 of the exercise apparatus 10 includes a carriage assembly generally indicated by the numeral 140 in FIG. 3A. The carriage assembly has a rigid carriage frame 141 including a pair of lower longitudinal frame members 142 disposed in spaced, parallel relation. The lower longitudinal frame member have individual rearward end portions 143 and opposite forward end portions 144. The carriage frame 141 also has a pair of upper longitudinal frame members 145 having rearward end portions 146 and opposite forward end portions 147. The rearward end portions 146 of the upper longitudinal frame members and rearward end portions 143 of the lower longitudinal frame members 142 are mounted, as by welding, on a rear cross beam 155 of a cylindrical configuration. The forward end portions 144 of the lower longitudinal frame members are mounted on a front cross beam 156 of a cylindrical configuration, as by welding. The forward end portions 147 of the upper longitudinal frame members are mounted, as by welding, on the ends of interconnecting frame members 157 which are, in turn, mounted on the front cross beam 156. Brace members 158 interconnect the lower longitudinal frame members 142 and their respective corresponding upper longitudinal frame members 145. Upper and lower convergent brace members 159 and 160, respectively, are mounted, by welding, on the front cross beam 156 and forward end portions 147 of the upper longitudinal frame members 145 extending toward each other and are weldably secured relative to each other, as shown in the drawings. Extensions 161 of the upper convergent brace members 159 extend upwardly and rearwardly therefrom, as shown in the drawings.

A pair of rear roller mounting plates 170 are mounted on, and extend downwardly from, the opposite ends of the rear cross beam 155 beneath their respective rearward end portions 143 of the lower longitudinal frame members 142. Similarly, a pair of central roller mounting plates 171 are individually mounted on, and extend downwardly from, the lower longitudinal frame members 142 at approximately the junctures of the brace members 158 with their respective lower longitudinal frame members 142. Each of the rear roller mounting plates mounts a pair of spaced, parallel rear roller shafts 172 extending outwardly therefrom in predetermined spaced relation and individually rotationally mounting rear rollers 173 thereon. Similarly, the central roller mounting plates 171 individually mount central roller shafts 174 extending outwardly therefrom in spaced, parallel relation and individually rotationally mounting central rollers 175 thereon. The rear rollers 173 and central rollers 175 are spaced from each other and have arcuate channels extending peripherally thereabout so as rotationally to engage their respective arcuate track member 121 therebetween. Thus, the carriage assembly is mounted for movement on the arcuate track members by the rear rollers 173 on each side of the carriage assembly engaging the arcuate track member and by the central rollers 175 on each side of the carriage assembly engaging the arcuate track member. Thus, the carriage assembly is movable on the track assembly 120 between a retracted position shown in FIGS. 1, 2A, 2B and 4 and an advanced or extended position shown in FIGS. 3A and 3B.

A pair of bearing plates 180 are individually mounted on, and extend downwardly from, the lower convergent brace members 160. Bearings 181 are individually mounted on the bearing plates defining a primary pivot axis, or axis of rotation extending transversely of the carriage assembly 140. An engagement assembly is borne by the carriage assembly and is generally indicated by the numeral 182 in FIG. 3B. The engagement assembly has a pair of pivotal mounting assemblies 183 which are individually mounted for pivotal movement in the bearings 181 about the axis of rotation defined thereby and are mounted on mounting plates 184 individually interconnected by a cross member 185 parallel to the axis of rotation defined by the bearings 181.

A pair of arms, or arm members, 190 are individually mounted, as by welding, on the cross member 185 extending therefrom in spaced, substantially parallel relation thereto. The arm members have proximal portions 191 and opposite distal portions 192. The arm members have return bent portions 193 between the proximal and distal portions. Handles 194 are mounted on the distal portions 192 of the arm members extending inwardly toward each other and defining an axis parallel to the axis of rotation defined by the bearings 181. Each of the handles terminates in a terminal surface 195 which is right-angularly related to the axis defined by the handles. Suitable grips 196 are individually slidably received about the handles and disposed so as to expose the terminal surfaces 195 of the handles. A drive arm 200 is mounted, as by welding, on the arm member 190 on the right, as viewed in FIG. 1, extending, as shown in FIG. 3A, along a course substantially right-angularly related to the arm member.

Figure 3B:
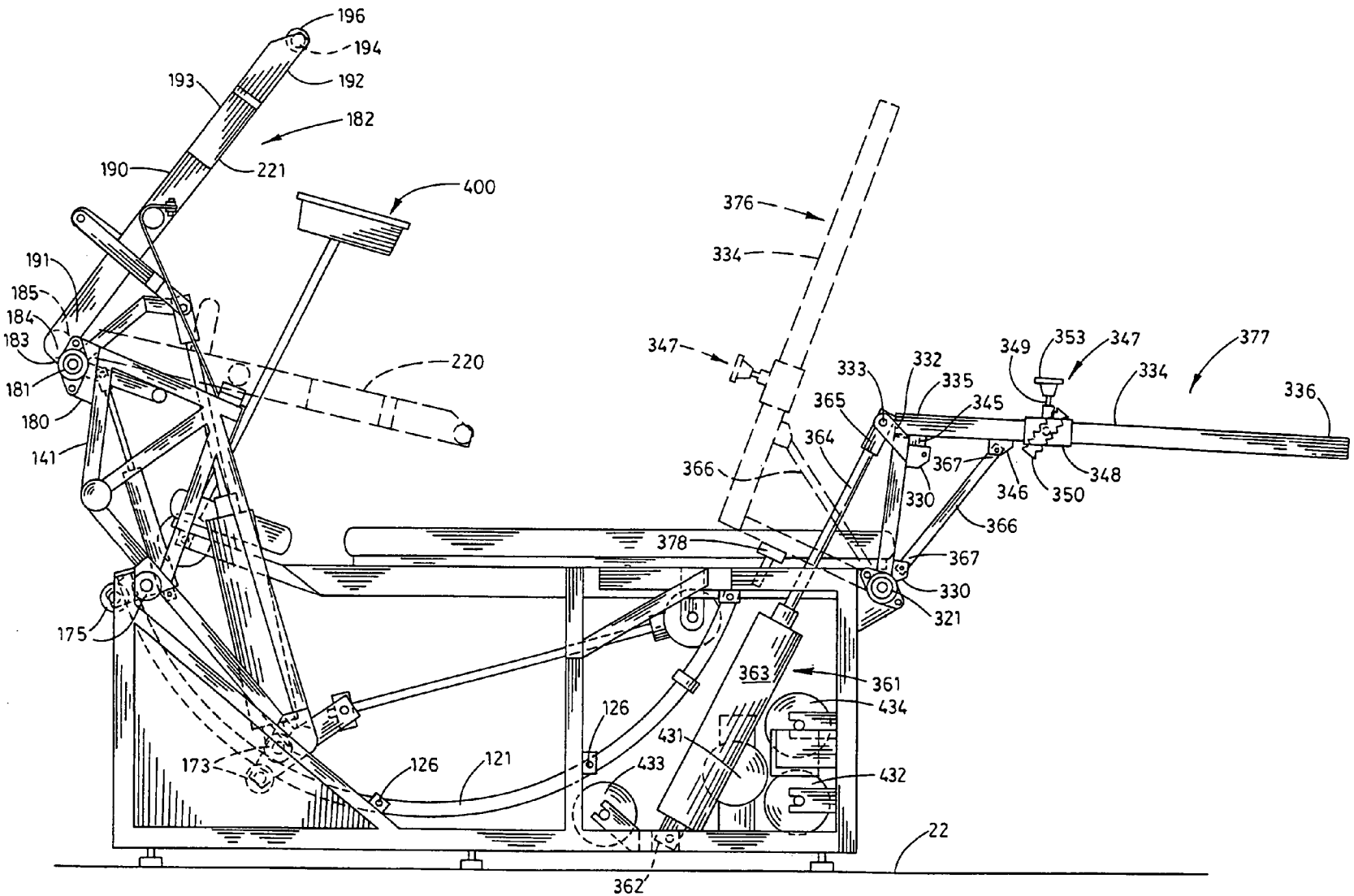
FIG. 3B is a side elevation of the exercising apparatus taken from a position indicated by line 3—3 in FIG. 1 showing the exercising members in phantom lines in retracted positions and in full lines in extended positions.

A travel limiting assembly 210 is mounted on the apparatus, as best shown in FIGS. 2A, 2B, 3A and 3B. The travel limiting assembly includes a clamp assembly 211 mounted on the extension 161 of the upper convergent brace member 159 on the right, as viewed in FIG. 1. Stop 212 is mounted on the upper portion of the clamp assembly. A strap fastening assembly 213 is mounted on the upper longitudinal frame member 145 on the right, as viewed in FIG. 1, immediately adjacent to the extension 161. Similarly, a strap fastening assembly 214 is mounted on the arm member 190 on the right, as viewed in FIG. 1, extending laterally therefrom for engagement with the stop 212 as shown in FIGS. 2A and 3A and in phantom lines in FIGS. 2B and 3B. A strap 216 is individually secured in and interconnecting the strap fastening assemblies 213 and 214 extending therebetween and looped about a strap arm 215, as shown in the drawings. The strap extends through the clamp assembly 211. Thus, the strap is operable to define the outer limit of movement of the engagement assembly 182 by engagement of the strap arm 215 with the strap, as shown in FIGS. 2B and 3B. Thus, the engagement assembly is movable between retracted positions 220 shown in phantom lines in FIGS. 2B and 3B and an extended position 221 shown in full lines in FIGS. 2B and 3B.

The exercising apparatus has a carriage positioning assembly generally indicated by the numeral 230 in FIG. 2A. The carriage positioning assembly includes a pair of mounting plates 231 individually mounted on, and extending downwardly from, the central support beams 84 and individually mounting a pair of bearings 232 thereon defining an axis of rotation extending transversely of the main frame 60. An electric drive motor 233 is mounted for pivotal movement in the bearings 232 about the axis of rotation defined by the bearings. The drive motor mounts an elongated screw threaded drive shaft 234 having a terminal end portion 235.

A pair of mounting plates 240 are individually mounted on the rear cross beam 155 of the carriage assembly 140 in adjacent spaced relation. An internally screw threaded drive sleeve or drive bushing 241 is pivotally mounted on, and between, the mounting plates and is screw-threadably received on the screw threaded drive shaft 234. Thus, it will be seen that operation of the drive motor 233 rotates the screw threaded drive shaft 234 in either direction thereabout to move the drive sleeve 241 therealong. Since the drive motor 233 is mounted in fixed position relative to the main frame, the rotation of the screw threaded drive shaft causes the carriage assembly 140 to be moved along the track assembly 120 between the positions shown in FIGS. 2A and 3A.

An exercise force resistance assembly of the exercise apparatus 10 is generally indicated by the numeral 250 in FIG. 2B. The exercise force resistance assembly has a major pneumatic cylinder assembly 251 including a cylinder mount 252 pivotally mounting a major pneumatic cylinder 253 on the rear cross beam of the carriage assembly. A cylinder rod 254 is extended pivotally from the major pneumatic cylinder and mounts a clevis assembly 255 at the distal end thereof. It will be understood that the major pneumatic cylinder has a piston therewithin connected to the cylinder rod in the conventional manner and resistant to movement of the engagement assembly in either direction between the retracted position 220 and extended position 221 due to pneumatic pressure on a selected side of the piston within the major pneumatic cylinder, as will hereinafter be discussed in greater detail.

A linkage assembly 260 operatively interconnects the clevis assembly 255 with the drive arm 200 of the engagement assembly 182. The linkage assembly includes a pair of link arms 261 mounted by pivot mounts 262 at the opposite ends thereof on the clevis assembly 255 and on the drive arm 200. Thus, the major pneumatic cylinder is operatively linked to the engagement assembly 182 to resist movement of the engagement assembly between the retracted position 220 in the extended position 221.

A minor pneumatic cylinder assembly 271 is mounted on the carriage assembly 140 of the exercising apparatus. The minor pneumatic cylinder assembly includes a cylinder mount 272 mounting the minor pneumatic cylinder 273 on the lower longitudinal frame member 142 of the carriage frame 141 on the right, as viewed in FIG. 1. The cylinder mount mounts a minor pneumatic cylinder 273 for pivotal movement thereon from which a cylinder rod 274 is extended mounting a clevis assembly 275 at the terminal end thereof. It will be understood that the cylinder rod mounts a piston within the minor pneumatic cylinder for relative movement to the left or right, as viewed in the drawings, in response to a pressure differential selectively applied on opposite sides of the piston.

The apparatus has a linkage which interconnects the clevis assembly 255 of the cylinder rod 254 of major pneumatic cylinder 253 and the upper convergent brace member 159. The linkage includes a first linking member or arm 280 mounted on the pivot mount 262 interconnecting the link arms 261 and the clevis assembly 255 by a first pivot mount 281. A second pivot mount 282 interconnects the distal end of the first linking arm with a second linking member or arm 283 which is, in turn, connected to the upper convergent brace member 159 on the right, as viewed in FIG. 1, by a third pivot mount 284. As can be seen in the drawings, the first linking arm 280 has a bend therein. The clevis assembly 275 of the minor pneumatic cylinder assembly 271 is pivotally connected to the second linking arm 283. Thus, the minor pneumatic cylinder 273 is operable to pivot the first linking arm 280 and second linking arm 283 from a first attitude or retracted position shown in FIGS. 2A and 3A to a second attitude or advanced positions shown in FIGS. 2B and 3B. For illustrative convenience, the position shown in FIG. 2A will be referred to as a first exemplary configuration 290 and the configuration shown in FIG. 2B will be referred to as a second exemplary configuration 291.

Lower Body Exercise Mechanism

The exercise apparatus 10 has a lower body exercise mechanism generally indicated by the numeral 315 in FIG. 2A. As most clearly visible in FIG. 4, four bearing plates 320 are individually mounted on the upper end portions 81 of the outer rearward frame members 80 and the upper end portions 83 of the inner rearward frame members 82. Rear bearings 321 are individually mounted on their respective bearing plates 320 to define an axis of rotation extending transversely of the main frame 60. Pivot shafts 322 are individually pivotally mounted in adjoining rear bearings 321. Pivot arms 323 are individually weldably mounted on each of the pivot shafts 322 in right angular relation thereto. The pivot arms have proximal portions 324 mounted on their respective pivot shafts and opposite distal end portions 325.

Two pair of attachment plates 330 are individually mounted on the proximal end portion 324 and on the distal end portion 325 of each pivot arm 323. The attachment plates of each pair are disposed in adjacent spaced relation. A linking pin 331 is positionable in holes extending through each pair of attachment plates 330, as shown in FIG. 4. Mounting plates 332 are individually secured, as by welding, on opposite sides of the distal end portion 325 of each pivot arm 323. A pivot assembly 333 is pivotally mounted on, and extends between, the mounting plates 332 and, in turn, pivotally mounts an outer member 334 thereon. The outer member has a proximal end portion 335, which is directly mounted on the pivot assembly, and an opposite distal end portion 336. A stop 345 is mounted on each outer member 334 in position for engagement with the attachment plates 330 of its respective pivot arm 323, as shown in FIG. 3B. Thus, the engagement of the stop with the attachment plates 330 stops the outer member in the position shown. A pair of attachment plates 346 is mounted on each of the outer members 334 in the positions most readily seen in FIG. 4.

An adjustable foot assembly 347 is slidably received on each outer member 334. Each adjustable foot assembly has an adjustment sleeve 348 which is slidably received on its respective outer member and which mounts a locking pin assembly 349. A pivotal foot rest 350 is pivotally mounted on the interior side of the adjustment sleeve and, thereby, on the interior side of its respective outer member. The foot rests are pivotal about pivot axes right-angularly related to their respective outer members. Each of the foot rests mounts a strap assembly 351 adapted operably to secure the foot, or shoe, of an operator therewithin for ease of operation. Each outer member has a plurality of locking pin holes 352 extending therealong in aligned spaced relation, as best shown in FIG. 1. The locking pin assembly 349 thereof may be pulled upwardly to release the pin thereof from its respective hole 352 for repositioning of the adjustment sleeve 348 along the outer member outwardly or inwardly. The locking sleeve can again be secured in position by releasing the locking pin for slidable receipt in a selected pin hole 352. A handle 353 is mounted on the outer end of the locking pin assembly for ease of grasping the locking pin assembly for operation thereof as previously described.

The exercise apparatus 10 mounts a pair of pneumatic cylinder assemblies generally indicated by the numerals 361. Each of the pneumatic cylinder assemblies includes a cylinder mounting assembly 362 which is pivotally mounted on the transverse frame member 98 of the main frame 60, as best shown in FIG. 4. A pneumatic cylinder 363 is mounted on the cylinder mounting assembly and has a cylinder rod 364 extended therefrom, in turn, mounting a rod mounting assembly 365 at the terminal end thereof. It will be understood that the cylinder rod within the pneumatic cylinder is connected to a piston which resists movement upwardly or downwardly, as viewed in the drawings, due to pneumatic pressure within the pneumatic cylinder on opposite sides of the piston. A linking arm 366, having opposite end portions 367, is pivotally mounted on each of the adjustment plates 346 at one opposite end portion thereof and is selectively mountable on either pair of attachment plates 330 using the linking pin 331.

The lower body exercise mechanism 315 is shown in FIG. 4 in a stored attitude 375. In contrast, the lower body exercise mechanism is shown in phantom lines in FIG. 3B in a retracted operational attitude 376 and in full lines in an extended operational attitude 377. A pair of stops 378 are individually mounted on the central support beams 84 for individual rested engagement by the pivot arms 323 in both the stored attitudes 375 and the retracted operational attitudes 376.

Referring more particularly to FIG. 1, an operator restraining assembly is generally indicated by the numeral 390 therein. The operator restraining assembly is intended principally for use in an environment of substantially reduced gravity, such as in a space vehicle operating in an extraterrestrial environment. The operator restraining assembly includes a pair of securing rings 391 individually mounted on the distal end portions 94 of the side frame members 93. A pair of retention strap assemblies 392 are secured individually on the securing rings and, in turn, mount a waist belt 393 through the medium of securing loops 394 thereof. The retention strap assemblies are releasably secured to the securing loops 394 of the waist belt 393 so that the operator is free selectively to attach and, alternatively, detach the waist belt 393 from the retention strap assemblies. Shoulder strap assemblies 395 individually releasably extend from the waist belt 393 over the shoulders of the operator and are again releasably secured in the front of the operator to the waist belt. Thus, the operator, when secured in the supine attitude 30, shown in FIG. 1, is retained in this attitude in contact with the contact surface 108 support assembly 107 and contact surface 110 of the head support assembly 109 even in a substantially gravity free environment.

Figure 5A:
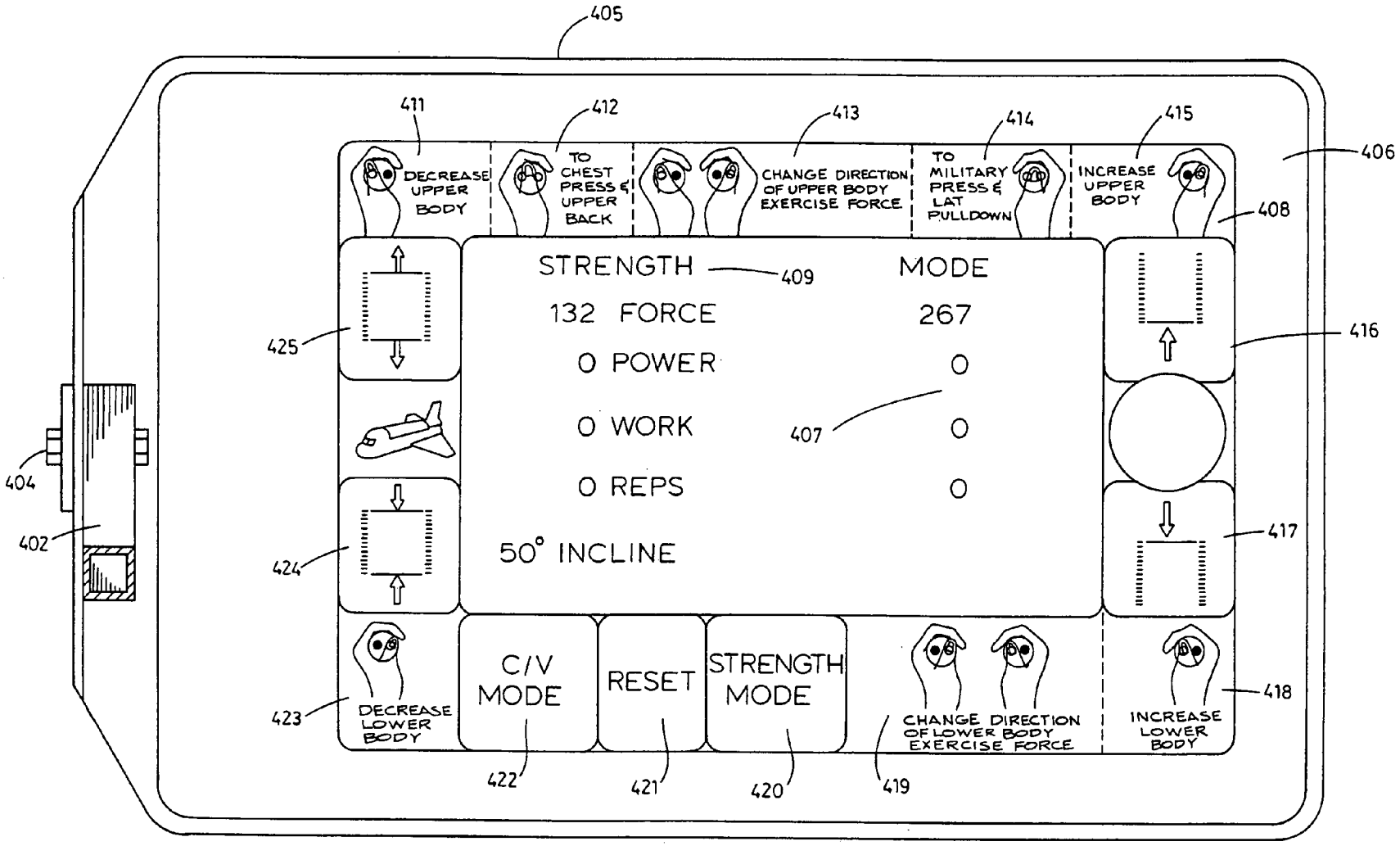
FIG. 5A is a somewhat enlarged, front elevation taken from a position indicated by line 5—5 in FIG. 1 and showing a second display area thereof in a first mode of operation.
Figure 5B:
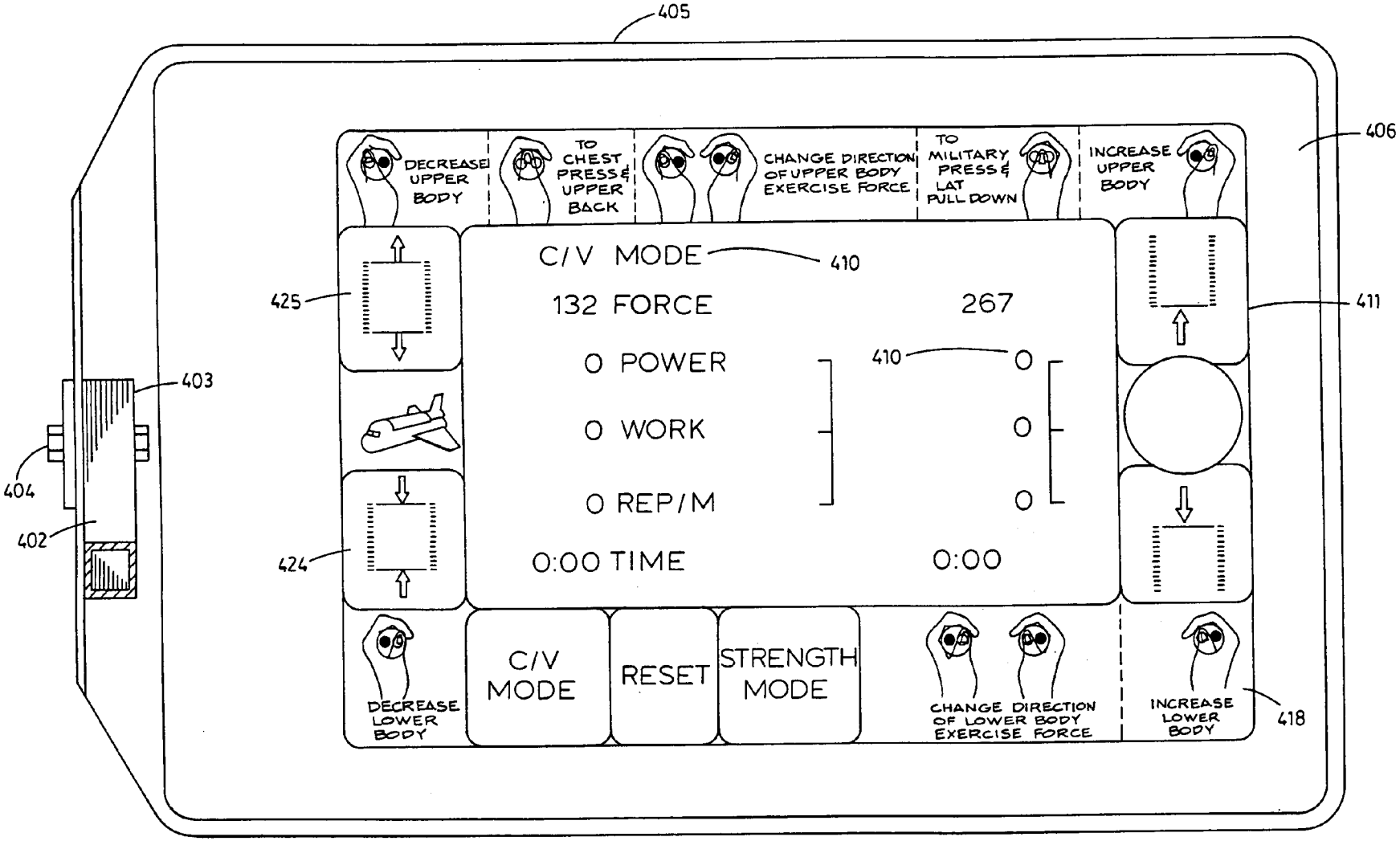
FIG. 5B is a somewhat enlarged, front elevation taken from a position indicated by line 5—5 in FIG. 1 and showing the second display area thereof in a second mode of operation.

The exercising apparatus 10 has a data display assembly generally indicated by the numeral 400. The data display assembly has a pivotal mounting assembly 401 on which is adjustably mounted an arm member 402. The arm member is mounted on the pivotal mounting assembly so as selectively to be adjustable about an axis of rotation extending transversely of the main frame 60 and is of a type permitting the arm member to be selectively secured in virtually any position about the axis of rotation for purposes hereinafter described. The arm member 402 extends to a distal end portion 403 on which is mounted an adjustment assembly 404. Display console 405 is mounted on the adjustment assembly 404 and is selectively securable thereon in virtually any attitude about an axis of rotation extending through the adjustment assembly which is also transversely extended relative to the main frame 60. In other words, as shown in FIGS. 5A and 5B, the display console 405 is pivotal about an axis of rotation parallel to the longitudinal or major axis of the display console. The display console houses a display screen 406 which may be of any suitable type.

Referring more particularly to FIGS. 5A and 5B, the display screen 406 may be visualized as having a central or first display area 407 surrounded by a peripheral or second display area 408. The first display area, in the preferred embodiment, has a first mode of operation 409 depicted in FIG. 5A and a second mode of operation 410 depicted in FIG. 5B. The second display area is comprised of a plurality of squares, or segments, containing indicia affording instructions to the operator. Thus, the second display area has a first segment 411 graphically providing instructions for the operator using his left hand to depress the left button to decrease the resistance to upper body exercising. Second segment 412 similarly graphically depicts instructions on how to convert the exercising apparatus for the performance of chest press and upper back exercising. Third segment 413 graphically depicts instructions on how to adjust the exercising apparatus for purposes of changing the direction of the upper body exercising force. The fourth segment 414 graphically depicts instructions on how the operator can change the configuration of the exercising apparatus for the performance of a military press and lateral muscular pull down exercise. The fifth segment 415 graphically depicts instructions on how the operator adjusts the exercising apparatus to increase resistance to upper body exercising. The sixth segment 416 constitutes a pressure sensitive pad which, if depressed, moves the upper end of the vertical bars on the right in the first display area as shown in FIG. 5B up in increments. The seventh segment 417 constitutes a pressure pad which, if depressed, moves the lower end of the vertical bars on the right in the first display area as shown in FIG. 5B down in increments. The eighth segment 418 graphically depicts how the operator adjusts the machine to increase resistance to lower body exercising. The ninth segment 419 graphically depicts how the operator adjusts the machine to change the direction of the lower body exercise force. The tenth segment 420 constitutes a pressure sensitive pad having the indicia "STRENGTH MODE" and which can be pressed to display the first mode 409 in the first display area 407. The eleventh segment 421 contains the indicia "RESET" and is a pressure pad which, if depressed, resets the accumulated display date in the first display area to zero. The twelfth segment 422 contains the indicia "C/V MODE" which may be pressed to display the second mode 410 in the second display area as depicted in FIG. 5B. The thirteenth segment 423 graphically depicts how the operator can decrease the resistance to lower body exercising. The fourteenth segment 424 is a pressure pad which, if depressed, increases the length of the vertical bars on the right in FIG. 5B. The fifteenth segment 425 is a pressure pad which, if depressed, decreases the length of the vertical bars on the right in FIG. 5B.

The exercising apparatus of the present invention can employ any suitable control system for operation of the operative portions thereof. However, the control system 426 of the preferred embodiment of the present invention has unique operative advantages. The control system 426 includes an electrical system generally indicated by the numeral 427 and shown in the schematic diagram of FIG. 6. Similarly the control system 426 includes a pneumatic system 430 also illustrated in the schematic diagram of FIG. 6.

Pneumatic System

The pneumatic system 430 has an air compressor 431 and an air compressor accumulator 432. The pneumatic system has an upper body accumulator 433 and a lower body accumulator 434. Accumulators 432, 433 and 434 may be of any suitable type such as the compression reservoir assemblies shown and described in the Keiser U.S. Pat. No. 4,257,593.

The pneumatic system 430 has three gauge pressure transducers 440, 441 and 442, respectively. Similarly, the pneumatic system has a pair of absolute pressure transducers 443 and 444.

The pneumatic system 430 has three upper body high flow valves 450, 451 and 452, respectively. Similarly, the pneumatic system has a pair of lower body high flow valves 453 and 454. The pneumatic system has a pair of upper body fast fill valves 460 and 461 and a pair of upper body proportional valves 462 and 463, respectively. The pneumatic system has a pair of lower body fast fill valves 470 and 471 and a pair of lower body proportional valves 472 and 473.

As indicated in FIGS. 5A and 5B and as can be visualized upon reference to FIG. 1, the exercising apparatus is operable from the operator's station 111 by the operator. This is accomplished, as will hereinafter be described in greater detail through the medium of an upper left member or button 480 and a lower left member or button 481 mounted within the handle 194 on the left, as viewed in FIG. 1, and extending through the terminal surface 195 thereof. Similarly, an upper right member or button 482 and a lower right member or button 483 are mounted within the handle 194 on the right, as viewed in FIG. 1, and extend through the terminal surface 195 thereof.

Figure 6:
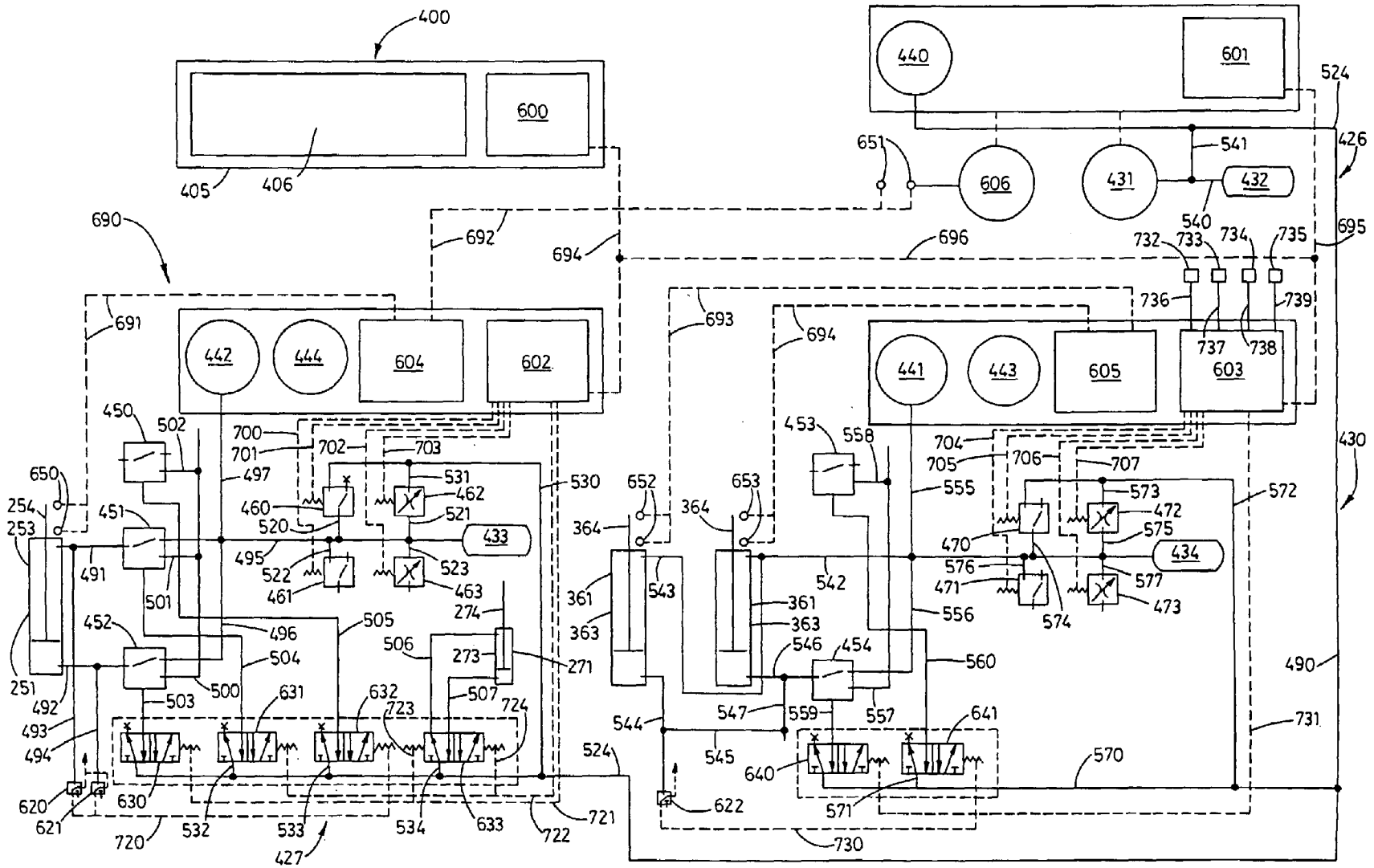
FIG. 6 is a schematic diagram of the pneumatic and electrical systems of the exercising apparatus of the present invention.

The pneumatic system 430 includes a pneumatic circuit 490, shown in the schematic diagram of FIG. 6. The pneumatic circuit includes a pneumatic conduit 491 interconnecting the rod end of the major pneumatic cylinder 251 and the upper body high flow valve 451. Similarly, a pneumatic conduit 492 operatively interconnects the opposite end of the major pneumatic cylinder 251 and the upper body high flow valve 452. A pneumatic conduit 493 is operatively connected to pneumatic conduit 491. A pneumatic conduit 494 is operatively connected to pneumatic conduit 492. A pneumatic conduit 495 operatively interconnects upper body high flow valve 451 and upper body accumulator 433. Pneumatic conduit 496 operatively interconnects pneumatic conduit 495 and upper body high flow valve 452. Pneumatic conduit 497 operatively interconnects pneumatic conduit 495 and gauge pressure transducer 442.

Pneumatic conduit 500 operatively interconnects upper body high flow valve 452 and extends as a vent to atmosphere. Pneumatic conduit 501 operatively interconnects pneumatic conduit 500 and upper body high flow valve 451. Pneumatic conduit 502 operatively interconnects pneumatic conduit 500 and upper body high flow valve 450. Pneumatic conduit 503 is operatively connected to upper body high flow valve 452. Pneumatic conduit 504 is operatively connected to upper body high flow valve 451. Pneumatic conduit 505 is operatively connected to upper body high flow valve 450. Pneumatic conduit 506 is operatively connected to the rod side of minor pneumatic cylinder 273. Pneumatic conduit 507 is operatively connected to the opposite end of minor pneumatic cylinder 273.

Pneumatic conduit 520 operatively interconnects pneumatic conduit 495 and upper body fast fill valve 460. Pneumatic conduit 521 operatively interconnects pneumatic conduit 495 and upper body proportional valve 462. Pneumatic conduit 522 operatively interconnects pneumatic conduit 495 and upper body fast fill valve 461. Pneumatic conduit 523 operatively interconnects pneumatic conduit 495 and upper body proportional valve 463. Pneumatic conduit 524 is operatively connected to gauge pressure transducer 440.

Pneumatic conduit 530 operatively interconnects upper body fast fill valve 460 and pneumatic conduit 524. Pneumatic conduit 531 operatively interconnects pneumatic conduit 530 and upper body proportional valve 462. Pneumatic conduit 532 is operatively connected to pneumatic conduit 524. Pneumatic conduit 533 is operatively connected to pneumatic conduit 524. Pneumatic conduit 534 is operatively connected to pneumatic conduit 524.

Pneumatic conduit 540 operatively interconnects air compressor 431 and air compressor accumulator 432. Pneumatic conduit 541 operatively interconnects pneumatic conduit 524 and pneumatic conduit 540. Pneumatic conduit 542 operatively interconnects the rod side of the pneumatic cylinder 363 on the right, as viewed in FIG. 6, and lower body accumulator 434. Pneumatic conduit 543 operatively interconnects the rod side of the pneumatic cylinder 363 on the left, as viewed in FIG. 6, and pneumatic conduit 542. Pneumatic conduit 544 is operatively connected to the opposite end of the pneumatic cylinder 363 on the left, as viewed in FIG. 6. Pneumatic conduit 545 is operatively connected to pneumatic conduit 544. Pneumatic conduit 546 operatively interconnects the lower end of pneumatic cylinder 363 on the right, as viewed in FIG. 6, and lower body high flow valve 454. Pneumatic conduit 547 operatively interconnects pneumatic conduit 546 and pneumatic conduit 545 and vents to atmosphere.

Pneumatic conduit 555 operatively interconnects gauge pressure transducer 441 and pneumatic conduit 542. Pneumatic conduit 556 operatively interconnects pneumatic conduit 542 and lower body high flow valve 454. Pneumatic conduit 557 is operatively connected to lower body high flow valve 454 and vents to atmosphere. Pneumatic conduit 558 operatively interconnects lower body high flow valve 453 and pneumatic conduit 557. Pneumatic conduit 559 is operatively connected to lower body high flow valve 454. Pneumatic conduit 560 is operatively connected to lower body high flow valve 453.

Pneumatic conduit 570 is operatively connected to pneumatic conduit 524. Pneumatic conduit 571 is operatively connected to pneumatic conduit 570. Pneumatic conduit 572 operatively interconnects lower body fast fill valve 470 and pneumatic conduit 570. Pneumatic conduit 573 operatively interconnects pneumatic conduit 572 and lower body proportional valve 472. Pneumatic conduit 574 operatively interconnects lower body fast fill valve 470 and pneumatic conduit 542. Pneumatic conduit 575 operatively interconnects lower body proportional valve 472 and pneumatic conduit 542. Pneumatic conduit 576 operatively interconnects pneumatic conduit 542 and lower body fast fill valve 471. Pneumatic conduit 577 operatively interconnects pneumatic conduit 542 and lower body proportional valve 473.

Electrical System

The electrical system 427 of the control system 426 of the exercising apparatus 10 includes four microprocessors 600, 601, 602 and 603. The electrical system further includes sonar position processing circuits 604 and 605 and linear actuator 606. The electrical system further includes pressure switches 620, 621 and 622.

The electrical system 427 includes six electrically operated solenoid valves identified by reference numerals 630, 631, 632, 633, 640 and 641, respectively. The solenoid valves are selectively operated to control the flow of compressed air in the pneumatic system 430 through the pneumatic conduits individually connected thereto, as shown in FIG. 6.

The electrical system has a pair of sonar transducers 650 mounted in predetermined positions adjacent to the cylinder rod 254 of the major pneumatic cylinder assembly 251. Similarly, a pair of sonar transducers 651 are mounted in predetermined positions adjacent to the linear actuator 606. A pair of sonar transducers 652 are mounted in predetermined positions adjacent to the cylinder rod 364 of pneumatic cylinder 363 on the left, as viewed in FIG. 6. A pair of sonar transducers 653 are mounted in predetermined positions adjacent to the cylinder rod 364 of pneumatic cylinder 363 on the right, as viewed in FIG. 6.

The electrical system 427 includes an electrical circuit 690. The electrical circuit includes an electrical conductor 691 which operatively interconnects the sonar transducers 650 and the sonar position processing circuit 604. Electrical conductor 692 operatively interconnects sonar position processing circuit 604 and sonar transducers 651. Electrical conductor 693 operatively interconnects sonar transducers 652 and sonar position processing circuit 605. Electrical conductor 694 operatively interconnects sonar transducers 653 and sonar position processing circuit 605. Electrical conductor 695 operatively interconnects microprocessor 601 and microprocessor 603. Electrical conductor 696 operatively interconnects electrical conductor 694 and electrical conductor 695 serving as a means for communication with other exercising apparatuses if used on site or otherwise.

Electrical conductor 700 operatively interconnects upper body fast fill valve 461 and microprocessor 602. Electrical conductor 701 operatively interconnects upper body fast fill valve 460 and microprocessor 602. Electrical conductor 702 operatively interconnects upper body proportional valve 463 and microprocessor 602. Electrical conductor 703 operatively interconnects upper body proportional valve 462 and microprocessor 602. Electrical conductor 704 operatively interconnects lower body fast fill valve 471 and microprocessor 603. Electrical conductor 705 operatively interconnects lower body fast fill valve 470 and microprocessor 603. Electrical conductor 706 operatively interconnects lower body proportional valve 473 and microprocessor 603. Electrical conductor 707 operatively interconnects lower body proportional valve 472 and microprocessor 603.

Electrical conductor 720 operatively interconnects the pressure switches 620 and 621 and the solenoid valve 632. Electrical conductor 721 operatively interconnects solenoid valve 630 and microprocessor 602. Electrical conductor 722 operatively interconnects solenoid valve 631 and microprocessor 602. Electrical conductor 723 operatively interconnects solenoid valve 633 and electrical conductor 721. Electrical conductor 724 operatively interconnects solenoid valve 633 and electrical conductor 722.

Electrical conductor 730 operatively interconnects pressure switch 622 and solenoid valve 641. Electrical conductor 731 operatively interconnects solenoid valve 640 and microprocessor 603. Electrical switches 732, 733, 734 and 735 are individually operatively connected to the buttons 480, 481, 482 and 483, respectively. These electrical switches 732, 733, 734 and 735 are, in turn, individually operatively connected to the microprocessor 603 by electrical conductors 736, 737, 738 and 739, respectively.

As will be appreciated, the precise location of many of the components of the control system 426 can be in any suitable location. In the preferred embodiment, it has been found convenient to locate some of these components on the carriage assembly 140. In addition, the electrical circuit heretofore described communicating with the buttons 480 and 481 and the buttons 482 and 483 must pass to the carriage assembly, or more specifically, to the engagement assembly 182 borne thereby. For purposes of allowing physical communication to the carriage assembly and the portions borne thereby from the remainder of the exercising apparatus, a power cable 740 is shown in the drawings extending from the exercising apparatus to the carriage assembly 140.

Operation

The operation of the described embodiment of the subject invention is believed to be clearly apparent and is briefly summarized at this point.

The exercising apparatus 10 is shown in FIG. 4 in the illustrative operative environment in a collapsed, or stored configuration. When so collapsed, the exercising apparatus is of a length less than the height of an average human being. The vertical thickness of the exercising apparatus when so collapsed is, in this configuration, less than four times the thickness of an average human being. When so collapsed, the exercising apparatus can be stowed in a storage bay, not shown, or simply left mounted in position, but disposed in the collapsed configuration, shown in FIG. 4, for use as needed. Since, in a gravity free environment, designations such as "up" and "down" may have no meaning, the description hereinafter provided will reference relative positions having meaning in this operative environment. However, as previously noted, while the exercising apparatus is uniquely well suited to use in a gravity free environment for purposes hereinafter described, the exercising apparatus is equally well suited to usage in normal operative environments on the surface of the earth.

The exercising apparatus 10, as shown in FIG. 4, is in a collapsed, or stored, configuration. The exercising apparatus can be converted to an operative configuration, as will now be described. The linking pins 331 are slidably removed from the attachment plates 330 on the left, as viewed in FIG. 4. This frees the linking arms 366 to be moved to the attachment plates on the right, as viewed in FIG. 4. The linking pins 331 are then inserted through the holes of the attachment plates on the right and through the corresponding holes in the linking arms 366. Thus, the outer members 334 are moved to the retracted operational attitudes 376, shown in phantom lines in FIG. 2B and FIG. 3B. In this position the stops 345 engage the attachment plates 330, as shown in FIG. 2A. This engagement, coupled with the interconnection of the linking arms 366, as just described, fixes the outer members in the retracted operational attitudes 376 for movement during exercise between the retracted operational attitudes 376 and the extended operational attitudes 377.

With the outer members 334 in the retracted operational attitudes 376, the adjustable foot assemblies 347 are moved to the desired positions along the outer members. This is achieved by pulling upwardly on the locking pin assemblies 349 thereof and slidably moving the adjustment sleeves 348 along the outer members to the desired positions. Once the desired positions are reached, the locking pin assemblies are pushed into the pin holes 352 coincident with the selected positions. The positions selected are, of course, those at which the feet 52 of the operator 29 will apply pressure during exercising.

The exercising apparatus 10 is, at this time, in the configuration shown in FIG. 2A. This may be the desired configuration for the exercising apparatus to be in when the operator 29 assumes the supine attitude 30 in the operator's station 111. However, if desired, the carriage assembly 140 can be moved along the track assembly 120 to a different position between the first exemplary configuration 290, shown in FIG. 2A, and the extended position, shown in FIG. 3A. This can be achieved by depressing the buttons 480, 481, 482 and 483 in the combinations indicated by the indicia contained in the second display area 408 heretofore described.

As previously noted, the operation of the exercising apparatus 10 is described, for illustrative convenience, in an operative environment of no gravity, or of substantially reduced gravity, such as a space vehicle travelling through extraterrestrial space. Thus, as shown in FIG. 1, the operator 29 may be visualized as an astronaut exercising in a space vehicle having an artificial atmosphere and pressure, but having no gravity, or of substantially reduced gravity such as aboard a space vehicle or space station orbiting the planet earth. For use in such an environment, the operator restraining assembly 390 is employed to retain the operator in the supine attitude 30, shown in FIG. 1, with his back 33 restrained in contact with the contact surface 108 of the body support assembly 107 and the contact surface 110 of the head support assembly 109. The waist belt 393 is releasably secured about the waist 49 of the operator and the shoulder strap assemblies 395 extended over the shoulders 37 of the operator and releasably secured on the waist belt 393. With the retention strap assemblies 392 secured on the securing rings 391 of the main frame 60, the operator is retained in the supine attitude 30 notwithstanding the fact that the operator may be exercising in a substantially gravity free environment.

Similarly, the operator 29 individually places his feet 52 in the strap assemblies 351 of the adjustable foot assemblies 347, also as shown in FIG. 1. The operator individually grasps the grips 196 of the arm members 190 in his hands 39. In this attitude, the operator can extend his thumbs 41, as desired, for operation of the buttons 480, 481, 482 and 483 to control operation of the exercising apparatus, as will hereinafter be described in greater detail.

Simultaneously the data display assembly 400 is pivoted to a position, such as shown in FIG. 1, wherein the display screen 406 of the display console 405 is in position for convenient observation of the display screen by the operator. Adjustment of the data display assembly is achieved by operation of the pivotal mounting assembly 401 and adjustment assembly 404, as previously described.

When the operator 29 is in the supine attitude 30 substantially as shown in FIG. 1, exercising can begin. The lower body exercise mechanism 315 can be operated by applying a pushing force simultaneously, or in alternating strokes, with the legs 50 of the operator. The pressure is applied to the pivot foot rest 350 in strokes so as to move the outer member between the retracted operational attitude 376 and extended operational attitude 377. In movement from the retracted operational attitude to the extended operational attitude, force is transmitted to the cylinder rods 364 of the pneumatic cylinders 363 through the medium of the pivot assemblies 333. Pneumatic resistance is applied by the pneumatic cylinders 363 to resist such motion by operation of the piston, not shown, within each pneumatic cylinder 363. Upon reaching the extended operational attitudes 377, the operator reduces the force exerted so that pneumatic pressure overrides the pressure exerted by the operator and returns the outer member from the extended operational attitude 377 to the retracted operational attitude 376 in what are known as concentric-eccentric strokes. Depending upon the program of exercising prescribed, the operator may, or may not, resist such return motion for purposes of exercise. This process is repeated during exercising in the normal manner.

The operation of the upper body exercise mechanism 115 is somewhat different, as hereinafter described. As previously noted, the carriage assembly 140 can be positioned in any desired position between the retracted position, shown in FIG. 2A, and the extended position, shown in FIG. 3A. Positioning of the carriage assembly within this range as desired is achieved by the operator depressing the buttons 480, 481, 482 and/or 483 in the combinations as instructed by the indicia displayed in the second display area 408. This causes the drive motor 233 to rotate the screw threaded drive shaft 234 in the required clockwise or counterclockwise direction of rotation to move the drive sleeve 241 in the desired direction therealong. This force is transmitted to the carriage assembly 140 to cause the carriage assembly to be pushed, or pulled, along the track assembly 120. More specifically, the rear rollers 173 and central rollers 175, on opposite sides of the carriage assembly, roll along their respective arcuate track members 121 and, thus, along the path defined thereby. Since, as previously noted, the arcuate track members are substantially concentric to the reference position 112 and, since the reference position is, essentially, coincident with an axis through the shoulders 37 of the operator 29, the carriage assembly and, more specifically, the engagement assembly 182 borne thereby are moved along a path substantially concentric to the reference position. Once the desired position is achieved, the carriage assembly is retained in the selected position along the track assembly by engagement of the screw threaded drive shaft 234 with the drive sleeve 241. The mounting plate 72 at corresponding ends of the arcuate track members 121 and the stop rings 127 at the opposite corresponding ends of the arcuate track members constitute and form a limit for such movement of the carriage assembly along the track assembly.

The engagement assembly 182, as previously noted, is movable under the impetus of the operator 29 between the retracted position 220 shown in phantom lines in FIGS. 2B and 3B and the extended positions 221 shown in full lines in FIGS. 2B and 3B. By comparing FIGS. 2B and 3B, it will be seen that the secondary path of movement of the engagement assembly can be varied through a range of nearly ninety degrees (90°) or, more specifically, from a path defined between the retracted and extended positions 220 and 221 shown in 2B. Positioning of the carriage assembly 140 along the track assembly 120 as previously described, causes selection of what path of movement is to be performed from the operator's station 111. In any case, the range of such secondary movement between the retracted and extended positions is limited by engagement of the arm member 190 on the right, as viewed in FIG. 1, with the stop 212 of the travel limiting assembly 210 and at the extended position by engagement of the strap arm 215 with the strap 216, as shown in FIGS. 2B and 3B.

The operator 29, once having selected the exercise desired using the commands provided by the indicia of the second display area 408 on the display screen 406, can begin exercising. This is achieved by exerting force against the handles 194 of the engagement assembly 182 away from the chest if, for example, the exercise is a chest press. Movement of the engagement assembly from the retracted position 220 toward the extended position 221 causes the force to be transmitted to the major pneumatic cylinder 253 through the medium of the linking assembly 260 connected to the engagement assembly 182. Such movement causes the piston within the major pneumatic cylinder 253 to be drawn against air pressure therewithin to the left of the piston to afford resistance to such movement and therefore exercising resistance for exercising by the operator. In the return stroke from the extended position 221 toward the retracted position such air pressure to the left of the piston returns the exercising assembly to the retracted position as the operator permits this to occur. This process of reciprocal movement is repeated for such exercising in such concentric-eccentric strokes.

If, for example, the operator selects a pull down, the buttons 480, 481, 482 and 483 are depressed, as instructed by the indicia and the control system applies air pressure to the right side of the piston as viewed, for example, in FIG. 2B so that the pull down exercise can be performed.

Unlike any exercising device heretofore known in the art, the path of such reciprocal exercising can be modified during exercising by moving the carriage assembly 140 along the track assembly 120 literally during such continuous exercising. Following the commands indicated by the indicia of the second display area 408, the carriage assembly 140 can be moved through the medium of the drive motor 233 and screw threaded drive shaft 234 to position the carriage assembly in any of the positions between that shown in FIG. 2B and that shown in FIG. 3B. Notably, movement between these two positions can be continuous during such exercising, if desired, so that the operator can exercise different muscle combinations during each exercising stroke throughout the entire period of such exercising through continuous movement of the carriage assembly along the track assembly during such exercising.

In addition, the resistance force provided to both the upper body exercise mechanism 115 and the lower body exercise mechanism 315 can be varied individually as desired by the operator 29 following the commands of the indicia of the second display area 408. Thus, pneumatic resistance for the legs 50 of the operator and/or for the arms 38 of the operator can be increased or decreased or retained the same during such continuous exercising or adjusted between different exercises as desired.

Still further, the effective pivot point of the interconnection of the major pneumatic cylinder assembly 251 and the engagement assembly 182 can be varied for purposes of converting the exercising apparatus from the shoulder press configuration of FIG. 2A, for example, to the lat pull down configuration of FIG. 2B in exercising, as already described. This is preferably automatically performed by the control system by depressing the designated combination of buttons 480, 481, 482 and/or 483 in selecting the exercise to be performed, as already described. This is achieved using the minor pneumatic cylinder assembly 271. Following the commands indicated in the second display area 408, the cylinder rod 274 is thus extended or retracted to move the first linking arm 280 and the second linking arm 283 between the first attitude best shown in FIG. 3A and the second attitude best shown in FIG. 3B. When in the position shown in FIG. 3A, the path of movement of the clevis end of the cylinder rod 254 is substantially as if link arm 280 did not exist. This causes the major pneumatic cylinder to pivot relative to the engagement assembly about pivot mounts 262. When the first linking arm 280 and second linking arm 283 are in the position shown in FIG. 3B, the pivot point for link arm 280 is in line with the primary pivot axis defined by the bearings 181 and thus the pivot axis of the engagement assembly 182. This causes the major pneumatic cylinder to pivot about the pivot point of the clevis assembly 255 of the cylinder rod 254. This adjustment causes the resistance curve of the exercising apparatus to be changed to accommodate the particular form of exercise involved.

Although the control system can be configured in any desired manner, it is preferably configured so that depression of the two buttons controlling the major pneumatic cylinder 253 effectively deactivates the major pneumatic cylinder. In other words, the pneumatic system equalizes air pressure on both sides of the piston therewithin permitting the operator freely to move the exercising assembly 182 to any desired position between the retracted and advanced positions. The control system, through the sonar transducers, senses where the cylinder rod 254 is and the microprocessor 603 through the pneumatic system applies air pressure to the interiors of the major and minor pneumatic cylinders on the correct sides of the pistons therewithin for the particular exercise to be performed as indicated by the position of the cylinder rod 254. Similarly, depression of the two buttons controlling the pneumatic cylinders 363 operates in the same manner to control the lower body exercising assembly.

When the program of exercising is concluded, the exercising apparatus 10 is returned to the collapsed or stored configuration, shown in FIG. 4, by a reversal of the steps previously described in readying the exercising apparatus for use.

Therefore, the exercising apparatus of the present invention permits upper body and lower body musculature to be exercised simultaneously; is readily adjusted to precise selected configurations for exercising under the control of the operator; affords the capability of exercising with precisely the same operative effects in substantially dissimilar environments including those of substantially reduced gravity; affords the capability of exercising in accordance with a program of exercise permitting both the resistance and the attitude of such exercising to be varied during substantially continuous exercising; is quite compact and suitable for use in operative environments such as spacecraft and in other extraterrestrial environments; and is otherwise entirely successful in achieving its operative environments.

Although the invention has been herein shown and described in what is conceived to be the most practical and preferred embodiment, it is recognized that departures may be made therefrom within the scope of the invention which is not to be limited to the illustrative details disclosed.

Having described my invention, what I claim as new and desire to secure by Letters Patent is:

1. An exercising apparatus operable to permit exercising by an operator selectively through a range of exercising movements during substantially continuous exercising, the apparatus comprising:

a frame having a contact surface defining an operator's station adapted to receive an operator in a supine attitude with the operator's upper body adjacent to a first end thereof and the operator's lower body adjacent to an opposite second end thereof;

a track mounted on the frame adjacent to said first end thereof defining a first path of travel substantially aligned with and offset relative to the first end of the operator's station;

a carriage supported by the track for movement along the first path of travel;

a drive mechanism coupled to the carriage to move the carriage along the first path of travel;

a pair of arms mounted on the carriage for individual substantially pivotal movement about a pivot axis that extends substantially normal to the first path of travel;

a pneumatic system that is operably connected to said pair of arms so as to selectively resist said individual substantially pivotal movement of the arms about said pivot axis for purposes of exercising the upper body of the operator through a range of exercising movements; and a pair of control members mounted on at least one of said pair of arms, one of which is operable to operate the drive mechanism to move said carriage to a selected position along the first path of travel and the other of which is operable selectively to increase or alternatively to decrease the amount of resistance applied to resist said individual substantially pivotal movement of the arms whereby the operator can individually selectively control the amount of resistance to said exercising and said range of exercising movements.

2. The apparatus of claim 1, wherein said track is arcuate and is mounted on the frame beneath said first end of the operator's station.

3. The apparatus of claim 1, including a pair of leg members mounted on said frame adjacent to said second end for individual substantially pivotal movement about a pivot axis substantially normal to a longitudinal axis of the operator's station.

4. The apparatus of claim 3, wherein said pneumatic system is individually operably connected to said pair of leg members to resist said individual substantially pivotal movement of the leg members about said pivot axis for purposes of exercising the lower body of the operator.

5. The apparatus of claim 4, including a second pair of control members mounted on at least one of said pair of arms which are individually operable selectively to increase, or alternatively to decrease, the amount of resistance applied to resist said individual substantially pivotal movement of the leg members whereby the operator can individually selectively control the amount of resistance to said exercising applied to the leg members.

6. The apparatus of claim 5, including at least one restraint borne by said frame for attachment to an operator received in said operator's station.

7. The apparatus of claim 5, wherein the arms and the leg members are individually moveable relative to said frame from retracted positions substantially overlaying said operator's station to extended positions constituting the respective termini of individual paths of pivotal movement of the arms of about the pivot axis thereof and of individual paths of pivotal movement of the leg members about the pivot axis thereof whereby said arms can be disposed in their respective retracted positions and the leg members of disposed in their respective retracted positions so as to dispose said apparatus in a compact configuration suitable for storage.

8. The apparatus of claim 7, including an electrical system connected in information receiving relation to said pneumatic system and an electrical display assembly deployed for observation and wherein said display assembly is operable to display indicia conveying said information received by the electrical system.

9. The apparatus of claim 8, wherein said electrical display assembly is mounted on a support arm that is borne by said frame, and is adapted to be deployed in an operational position that is viewable from the operator's supine attitude.

10. The apparatus of claim 9, wherein said support arm, on which the display assembly is mounted, is mounted on the frame for substantially pivotal movement from the operational position to a retracted position overlaying said operator's station in a compact configuration suitable for storage.

11. The apparatus of claim 9, wherein said electrical display assembly includes a display screen visible to the operator in said operational position and including a screen operable graphically to display said indicia in substantially discrete display areas, a first of which is substantially centrally disposed on the display screen and a second of which is substantially peripherally disposed relative to the first display area.

12. The apparatus of claim 11, wherein said first display area is adapted to display indicia revealing said operator's performance as determined by the pneumatic system and the electrical system, and wherein said second display area is adapted to display indicia providing instructions for operation of the apparatus.

13. The apparatus of claim 12, wherein said second display area displays indicia providing instructions for the operation of said first and second pairs of control members.

14. The apparatus of claim 13, wherein said first display area has at least two modes of operation, one of which displays indicia relating to the strength force applied in the operation of said arms and the other of which displays indicia relating to cardiovascular performance.

15. The apparatus of claim 13, wherein said first display area has at least two modes of operation, one of which displays indicia relating to the strength applied in the operation of said leg members and the other of which displays indicia relating to cardiovascular performance.

16. The apparatus of claim 14 or 15, wherein said second display area displays indicia instructing said operator on how to change the indicia displayed in the first display area between said first and second modes of operation.

17. The apparatus of claim 7, wherein the arms and the leg members at said respective termini of the individual paths of pivotal movement define a distance therebetween approximating the length of an average adult human body in the supine attitude.

18. The apparatus of claim 17, wherein the length of said apparatus in the compact configuration is less than the length of said average adult human body in the supine attitude.

19. The apparatus of claim 18, wherein the height of said apparatus in the compact configuration is less than four times the thickness of the operator's average adult human body in the supine attitude.

20. The apparatus of claim 7, wherein the resistance applied by the pneumatic system to said individual substantially pivotal movement of the arms and the leg members of said pair is within a range adapted substantially to duplicate corresponding pneumatic resistance applied in a magnitude of gravity equivalent to that on the surface of the planet Earth even though the apparatus is in an environment having a gravity different from that on the surface of the planet Earth.

21. An exercise apparatus comprising:

a stationary frame portion including an operator support having a first side configured to support at least a portion of a back of an operator and a generally opposite second side; and an operator input assembly, comprising:

a moveable frame portion being moveable relative to the stationary frame portion between at least a first position and a second position along an arcuate track that lies principally to the second side of the operator support;

a resistance assembly; and an operator engagement portion being configured to move relative to both the moveable frame portion and the operator support along at least one concentric exercise path and along at least one eccentric exercise path;

wherein the resistance assembly is configured at least selectively to provide positive resistance to the movement of the engagement portion along the at least one concentric exercise path and the at least one eccentric exercise path.

22. The exercise apparatus of claim 21, wherein the moveable frame portion is supported by an arcuate track assembly.

23. The exercise apparatus of claim 22, wherein the arcuate track assembly comprises a first arcuate track member and a second arcuate track member, the first and second arcuate track members being positioned generally parallel to one another on opposite sides of the moveable frame portion.

24. The exercise apparatus of claim 21, wherein the operator engagement portion is configured for pivotal movement relative to the moveable frame portion of the operator input assembly.

25. The exercise apparatus of claim 21, wherein the resistance assembly is configured to provide resistance independent of gravitational forces.

26. The exercise apparatus of claim 21, wherein the resistance assembly comprises a pneumatic cylinder assembly having a piston enclosed within a cylinder.

27. The exercise apparatus of claim 21 additionally comprising an operator input assembly position system including a motor powering a drive mechanism, the drive mechanism operating between the stationary frame portion and the movable frame portion to move the movable frame portion along the arcuate path.

28. The exercise apparatus of claim 21, wherein, in the first position of the moveable frame portion, the operator engagement portion is moveable along a first exercise path relative to the operator support and, in the second position of the moveable frame portion, the operator engagement portion is moveable along a second exercise path, the second exercise path not being aligned with the first exercise path.

29. An exercise apparatus comprising:

a stationary frame portion including an operator support;

an operator input assembly, comprising:

a moveable frame portion being moveable relative to the stationary frame portion between at least a first position and a second position along an arcuate path;

a resistance assembly; and an operator engagement portion being configured to move relative to both the moveable frame portion and the operator support; and an operator input assembly positioning system comprising a threaded drive shaft secured to the stationary frame portion, a drive sleeve connected to the moveable frame portion and in driving engagement with the drive shaft, wherein rotation of the drive shaft moves the operator input assembly along the arcuate path;

wherein the resistance assembly is configured to provide resistance to the movement of the engagement portion in at least one direction.

30. The exercise apparatus of claim 29, additionally comprising a motor configured to drive the drive shaft and a control assembly for controlling the motor.

31. An exercise apparatus, comprising:

a frame assembly;

a resistance assembly supported relative to the frame assembly and having an input connection point, the input connection point being moveable along a resistance path, the resistance assembly being configured to provide resistance to movement of the input connection point in at least one direction along the resistance path;

an operator input arm being pivotally coupled to the input connection point and pivotally connected to the frame assembly at a first pivot axis spaced from the input connection point;

a linkage assembly comprising a linkage member pivotally connected to the input connection point and having a second pivot axis spaced from the input connection point, the linkage member being moveable such that the second pivot axis is capable of moving from a first position substantially aligned with the first pivot axis to a second position spaced from the first pivot axis.

32. The exercise apparatus of claim 31, additionally comprising a control assembly for moving the linkage member between the first position and the second position.

33. The exercise apparatus of claim 32, wherein the control assembly comprises a pneumatic cylinder interconnected between the frame assembly and the linkage assembly.

34. The exercise apparatus of claim 31, wherein the resistance assembly comprises a pneumatic device.

35. The exercise apparatus of claim 31, wherein the linkage assembly comprises a second linkage member, a first end of the second linkage member being pivotally connected to the frame at a position spaced from the first pivot axis and a second end of the second linkage member being pivotally connected to the linkage member at the second pivot axis.

36. The exercise apparatus of claim 31, additionally comprising a stationary frame, the frame assembly being supported for arcuate movement relative to the stationary frame.

37. The exercise apparatus of claim 31, wherein the operator input arm is connected to the input connection point through the linkage member.

38. An exercise apparatus, comprising:

an operator support supported by a frame, said operator support configured to receive an operator in an operator's station having a first reference position;

a track mounted to said frame next to said operator support, said track defining an arc substantially concentric to said first reference position; and an engagement assembly including an operator engagement portion, and at least one pneumatic resistance device that is configured to oppose movement of the operator engagement portion in diametrically opposite directions, at least a portion of said engagement assembly being selectively moveable along said track relative to said first reference position;

wherein the first reference position is disposed to a first side of the operator support, and at least a portion of the track is disposed to a generally opposing second side of the operator support.

39. The exercise apparatus of claim 38, wherein the track defines at least first and second locations for said at least a portion of said engagement assembly relative to the first reference position, whereby positioning said at least a portion of said engagement assembly at said first location allows substantially parallel movement of said operator engagement portion relative to said operator support, and positioning said at least a portion of said engagement assembly at said second location allows substantially transverse movement of said operator engagement portion relative to said operator support.

40. An exercise apparatus, comprising:

an operator support supported by a frame, said operator support having generally opposing first and second sides, the first side configured to support at least a portion of a torso of an operator in a substantially stationary orientation;

a track mounted to said frame, the track being generally disposed to the second side of the operator support, and the track defining an arc substantially concentric to a first reference point disposed to the first side of the operator support; and an engagement assembly having an operator engagement portion, at least a portion of said engagement assembly being selectively moveable along said track relative to the first reference position, wherein for every position of engagement assembly along the track, the operator engagement portion is disposed-to the first side of the operator support.

41. The exercise apparatus of claim 40, wherein the first side of the operator support is configured to support at least a portion of a back of the operator.

42. The exercise apparatus of claim 40, wherein the exercise apparatus further includes a resistance assembly.

43. The exercise apparatus of claim 42, wherein the resistance assembly is configured to provide resistance independent of gravitational forces.

44. The exercise apparatus of claim 42, wherein the resistance assembly comprises a pneumatic device.

45. The exercise apparatus of claim 40, wherein the first reference point is substantially coincident with shoulders of the operator.

* * * * *

UNITED STATES PATENT AND TRADEMARK OFFICE

CERTIFICATE OF CORRECTION

PATENT NO. : 6,962,554 B2
APPLICATION NO. : 09/945026
DATED : November 8, 2005
INVENTOR(S) : Dennis L. Keiser It is certified that error appears in the above-identified patent and that said Letters Patent is hereby corrected as shown below:

Claim 7, Column 22

Line 20, before "about" delete "of".

Claim 7, Column 22

Line 23, after "members" delete "of".

Claim 20, Column 23

Lines 22-23, after "members" delete "of said pair".

Claim 40, Column 26

Line 20, after "of" insert --the--.

Claim 40, Column 26

Lines 21-22, delete "disposed-to" and insert --disposed to--, therefor.

Signed and Sealed this

Eighth Day of August, 2006

JON W. DUDAS
*Director of the United States Patent and Trademark Office*